US007694753B2

(12) United States Patent
Carlson et al.

(10) Patent No.: US 7,694,753 B2
(45) Date of Patent: Apr. 13, 2010

(54) DUAL ROD DRILL PIPE WITH IMPROVED FLOW PATH METHOD AND APPARATUS

(75) Inventors: Robin Carlson, Pella, IA (US); Randy R. Runquist, Knoxville, IA (US); Tod J. Michael, Chariton, IA (US); Shawn Moyer, University Park, IA (US)

(73) Assignee: Vermeer Manufacturing Company, Pella, IA (US)

( * ) Notice: Subject to any disclaimer, the term of this patent is extended or adjusted under 35 U.S.C. 154(b) by 282 days.

(21) Appl. No.: 11/805,695

(22) Filed: May 24, 2007

(65) Prior Publication Data

US 2007/0272444 A1 Nov. 29, 2007

Related U.S. Application Data

(60) Provisional application No. 60/808,303, filed on May 24, 2006.

(51) Int. Cl.
*E21B 17/18* (2006.01)
*E21B 21/12* (2006.01)

(52) U.S. Cl. ..... 175/215; 175/320; 285/123.1

(58) Field of Classification Search ..... 175/215, 175/320, 62; 285/123.1, 123.3
See application file for complete search history.

(56) References Cited

U.S. PATENT DOCUMENTS

| | | | | |
|---|---|---|---|---|
| 1,521,482 | A | | 12/1924 | Steele |
| 3,489,438 | A | * | 1/1970 | McClure ..... 285/123.15 |
| 4,378,057 | A | * | 3/1983 | O'Connell ..... 175/215 |
| RE38,418 | E | * | 2/2004 | Deken et al. ..... 175/19 |
| 6,827,158 | B1 | | 12/2004 | Dimitroff et al. |
| 6,892,829 | B2 | | 5/2005 | Livingstone |

FOREIGN PATENT DOCUMENTS

EP 0 648 915 A1 4/1995

OTHER PUBLICATIONS

International Search Report and Written Opinion mailed Sep. 2, 2008.

* cited by examiner

*Primary Examiner*—Giovanna C Wright
(74) *Attorney, Agent, or Firm*—Merchant & Gould P.C.

(57) ABSTRACT

A drill rod assembly including inner and outer drill rods. The drill rod assembly further including flow passages that are in fluid communication with an annular fluid flow path defined between the inner and outer drill rods. The passages preventing blockage of a drill string fluid flow path when a number of drill rod assemblies are interconnected to form a drill string.

21 Claims, 22 Drawing Sheets

DUAL ROD DRILL PIPE WITH IMPROVED FLOW PATH METHOD AND APPARATUS

CROSS-REFERENCE TO RELATED APPLICATION

This application claims the benefit of U.S. Provisional Application No. 60/808,303, filed May 24, 2006. Such application is incorporated herein by reference.

TECHNICAL FIELD

This disclosure generally relates to a drill rod assembly used for boring. More particularly, this disclosure relates to a drill rod assembly having inner and outer, coaxial drill pipes with an improved flow path. More particularly still, this disclosure relates to such a drill rod assembly used in a horizontal directional drilling (HDD) environment.

BACKGROUND

Drill strings are typically constructed of short, individual sections of drill pipes or rods. The drill rods attach to one another to form a drill string, which can extend significant distances in some drilling applications. The drill rods used in small to medium sized horizontal drilling machines are typically either ten feet or fifteen feet in length. A drill string often extends over one hundred to three hundred feet in length. Thus, it is not unusual for a drill string to be assembled using 10 to 30 sections of drill rods, or more.

Referring now to FIG. 1, one known drill rod assembly 10 used in conventional drilling systems is illustrated. The drill rod assembly 10 includes an outer tubular drill rod 30 having external threads on one end and internal threads on the opposite end. The drill rod assembly 10 further includes a smaller, inner drill rod 20. The inner drill rod 20 fits inside the tubular outer rod 30. As previously described, typical drill rods are either ten feet or fifteen feet in length. Drill rod assemblies having inner and outer rods, however, are uncharacteristically short, to address stack-up problems described in greater detail hereinafter. The illustrated drill rod assembly 10 is only three feet in length.

Drill rods are typically positioned in the drilling machine, with one end higher than the other; thus, the illustrated assembly 10 has an up-hill end 36 and a down-hill end 38, as shown. The inner drill rod 20 includes a hexagonal first end 29 and a hexagonal second end 27. A coupling 22 is affixed to the first end 29 by a cross pin 26 that passes through a hole 25 formed in the inner drill rod 20. The cross pin 26 has an interference fit such that the pin 26 remains fixed within the hole 25 of the inner drill rod 20 when properly installed. The cross pin 26 also passes through a slotted hole 23 formed in the coupling 22. The coupling 22 has a larger diameter D1 than that of an inner diameter ID1 of the outer drill rod 30 at the up-hill end 36 of the assembly 10. The larger outer diameter OD1 of the coupling 22 prevents the inner drill rod 20 from sliding through the outer drill rod 30. The inner drill rod 20 also includes an enlarged portion 28 located adjacent to the down-hill end 38 of the assembly 10. The enlarged portion 28 prevents the inner drill rod 20 from sliding through the outer drill rod 30 in an opposite direction.

The drill rod assembly 10 is constructed by installing the inner drill rod 20 into the outer drill rod 30 at the down-hill end 38 of the assembly 10. In particular, the inner drill rod 20 is installed within the outer drill rod 20 until the expanded portion 28 of the inner drill rod 10 contacts the outer drill rod 30, and limits longitudinal movement; or until the hole 25 of the inner drill rod 20 aligns with the slotted hole 23 of the coupling 22, so that the cross pin 26 can be inserted. The coupling 22 includes an internal hexagonal bore that mates with the hexagonal first end 27 of the inner drill rod to fix the coupling and inner drill rod rotationally. The mating hexagonal bore and the hexagonal first end 29 of the coupling and inner drill rod transmit torque, while the cross pin 26 simply holds the coupling 22 and the rod 20 in place.

When assembled, the inner drill rod assembly 20 freely moves in a longitudinal direction from the position illustrated in FIG. 1 to a position where the enlarged portion 28 of the inner drill rod 20 contacts the outer drill rod 30. That is, the inner drill rod 20 slides longitudinally between an up-hill position and a down-hill position. In the up-hill position, a gap is formed between the coupling 22 and the outer drill rod 30 at the up-hill end 36 of the assembly 10. In the down-hill position, the coupling 22 is flush with the outer drill rod 30 at the up-hill end 36 of the assembly.

FIG. 2 illustrates the drill rod assembly 10 coupled to a boring tool 40. The boring tool 40 is connected to the down-hill end 38 of the assembly 10. The boring tool 40 includes an outer casing 45 having an external threaded end 44. The boring tool 40 also includes an inner rod 42 and an attached coupling 43 having an internal hexagonal bore. Unlike the drill rod assembly 10, however, the inner rod 42 of the boring tool 40 is coupled to the outer casing 45 in a fixed position. That is, the inner rod 42 of the boring tool 40 does not longitudinally slide relative to the outer casing 45. Accordingly, when the drill rod assembly 10 is coupled to the boring tool 40, the fixed position of the inner rod 42 of the boring tool 40 determines the position of the inner drill rod 20 of the drill rod assembly 10 relative to the outer drill rod 30.

More specifically, when the drill rod assembly 10 is threaded onto the boring tool 40, the coupling 43 of the inner rod 42 engages with the second hexagonal end 27 of inner drill rod 20. The inner drill rod 20 is normally positioned as shown in FIG. 1 by gravity; i.e., positioned such that the coupling 22 is flush with the outer drill rod 30 at the up-hill end 36 of the assembly 10. As the assembly 10 threads onto the boring tool 40, the inner drill rod 20 of the assembly 10 is pushed or slides longitudinally toward the up-hill end 36 of the assembly. The inner drill rod 20 slides such that an axial gap 100 is created between the coupling 22 and the outer drill rod 30, as depicted in FIG. 2. In operation, the axial gap 100 serves as a fluid flow path that allows fluid to enter the drill rod assembly 10 and pass through an annular area between the inner and outer drill rods 20, 30. From the annular area of the assembly 10, the fluid passes through to the boring tool 40 to cool the boring tool and assist in the transportation of cuttings.

FIG. 3 illustrates first and second drill rod assemblies 10*a* and 10*b* connected to form a drill string. The same boring tool 40 is coupled to the down-hill end of the drill string (i.e., the down-hill end of the lowermost drill rod assembly 10*a*). The first drill rod assembly 10*a* is connected to the second drill rod assembly 10*b* by threading an externally threaded up-hill end 32*a* of the first outer drill rod 30*a* into an internally threaded down-hill end 34*b* of the second outer drill rod 30*b*. As the outer drill rods 30*a*, 30*b* are being coupled, the coupling 22*a* of the first inner drill rod 20*a* engages the hexagonal end 27*b* of the second inner drill rod 20*b*.

The drill string defines a fluid flow path that extends along the lengths of the drill rod assemblies 10*a*, 10*b*. In operation, fluid is pumped into the upper most drill rod assembly, through the fluid flow path, and into the boring tool for cooling and transporting cuttings. For example, referring specifically to FIG. 3, fluid is pumped into the annular area between the inner and outer drill rods 20*b*, 30*b* of the second drill rod assembly 10*b*, through the gap 100 of the first drill rod assembly 10*a*, then through the annular area between the inner and outer drill rods 20*a*, 30*a* of the first drill rod assembly 10*a*, and into the boring tool 40.

As previously described, the fixed position of the inner rod 42 of the boring tool 40 determines the position of the inner rod 20*a* of the first drill rod assembly 10*a*. That is, the position of the inner drill rod 20*a* becomes fixed relative to the outer drill rod 30*a* when attached to the boring tool 40. The now fixed positions of the first inner and outer drill rods 20*a*, 30*a* of the first drill rod assembly 10*a* accordingly determine the position of the second inner drill rod 20*b* relative to the second outer drill rod 30*b* of the second drill rod assembly 10*b*. As the second assembly 10*b* threads onto the first assembly 10*a*, the second inner drill rod 20*b* is pushed or slides longitudinally such that an axial gap 102 is created between the coupling 22*b* and the second outer drill rod 30*b*, as depicted in FIG. 3. Fluid now enters the drill string at the axial gap 102 of the second drill rod assembly 10*b*, passes through to the first drill rod assembly 10*a*, and further passes through to the boring tool 40 to cool the boring tool and assist in the transportation of cuttings.

The inner and outer drill rods 20, 30 of each of the drill rod assemblies 10*a*, 10*b* have unavoidable variations in length resulting from manufacturing tolerances. Because of the length variations, drill rod assemblies are designed such that the overall length of interconnected inner drill rods 20*a*, 20*b* is never longer than the overall length of interconnected outer drill rods 30*a*, 30*b*. If the interconnected inner drill rods were longer than the outer drill rods, the inner rods would collide while the outer drill rods were being threaded together, causing damage to one or both of the inner and outer drill rods. Accordingly, by design, the length of interconnected inner drill rods is slightly less than the length of interconnected outer drill rods. This design requirement, however, results in a situation where the second axial gap (e.g., 102) of an up-hill drill rod assembly (e.g., 10*b*) is less than the first axial gap (e.g., 100) of a down-hill drill rod assembly (e.g., 10*a*).

FIG. 4 illustrates a drill string with a boring tool 40 and four drill rod assemblies 10*a*, 10*b*, 10*c*, and 10*d*. The difference in the overall lengths of the interconnected inner and outer drill rods, and the manufacturing variations of the drill rods, are depicted in an exaggerated manner to better illustrate the effect of this design limitation.

FIG. 4*a* illustrates the first axial gap 100 defined by the position of the first coupling 22*a* relative to the outer drill rod 30*a* of the first drill rod assembly 10*a*. When the second drill rod assembly 10*b* is coupled to the first assembly 10*a*, the first end 29*a* of the first inner drill rod 20*a* contacts the second end 27*b* of the second inner drill rod 20*b* of the second assembly 10*b*, and determines the relative positions of the second inner and outer drill rods 20*b*, 30*b*.

FIG. 4*b* illustrates the second axial gap 102 defined by the position of the second coupling 22*b* relative to the outer drill rod 30*b* of the second drill rod assembly 10*b*. The axial gap 102 is smaller than the first axial gap 100. When the third drill rod assembly 10*c* is coupled to the second assembly 10*b*, the first end 29*b* of the second inner drill rod 20*b* contacts the second end 27*c* of the third inner drill rod 10*c* of the third assembly 10*c*, and determines the relative positions of the third inner and outer drill rods 20*c*, 30*c*.

FIG. 4*c* illustrates the position of the coupling 22*c* of the third drill rod assembly 10*c* relative to the third outer drill rod 30*c*. There is no gap (shown at arrow 104). Instead, the coupling 22*c* is seated against the up-hill end 32*c* of the third outer drill rod 30*c*. When the fourth drill rod assembly 10*d* is coupled to the third assembly 10*c*, the first end 29*c* of the third inner drill rod 20*c* is spaced apart from the second end 27*d* of the fourth inner drill rod 20*d*. The space between these ends 29*c*, 27*d* of the inner drill rods 20*c*, 20*d* is caused by the fact that the coupler 22*d* (FIG. 4*d*) of the fourth assembly 10*d* has contacted the uphill end 32*d* of the outer drill rod 30*d*; thereby positioning the fourth inner drill rod 20*d* relative to the outer drill rod 30*d*. That is, the inner drill rod 20*d* can no longer shift or slide down longitudinally toward the down-hill end of the assembly, but is instead stopped by contact between the coupling 22*d* and the outer drill rod 30*d*.

Because of the design requirement that the inner rods always be shorter than the outer rods, any drill rod assemblies subsequently added to the fourth drill rod assembly 10*d* will have inner and outer drill rods similarly positioned as shown in FIG. 4*d*. That is, the couplings 22 of subsequently added drill rod assemblies 10 will be in contact with the outer drill rods 30, such that no gaps exist in the drill string. This results in a blockage of the fluid flow path of the drill string. Such blockages are a known problem in the industry.

In view of the foregoing, there exists a need for a drill rod assembly, having inner and outer coaxial drill rods, that minimizes and/or eliminates restricted fluid flow paths upon assembly into a drill string.

SUMMARY

The present invention relates to a rod assembly an outer drill rod and an inner drill rod positioned within the outer drill rod. An annular fluid flow path is defined between the inner and outer drill rods. The outer drill rod includes an internal shoulder, while the inner rod includes an external shoulder sized to engage the internal shoulder. Engagement of the internal and externals shoulders limits movement of the inner drill rod relative to the outer drill rod in a first longitudinal direction. A coupling attached to the second end of the inner drill rod limits movement of the inner drill rod relative to the outer drill rod in a second opposite longitudinal direction.

One feature of the present invention relates to providing fluid flow passages in the coupling such that the passages are in fluid communication with the annular fluid flow path when the coupling is seated against the outer drill rod. Another feature of the present invention relates to providing fluid flow passages in the external shoulder of the inner drill rod such that the passages are in fluid communication with the annular fluid flow path when the external shoulder of the inner drill rod is seated against the internal shoulder of the outer drill rod. Still another feature of the present disclosure relates to a fluid flow passage formed in the inner drill rod.

Therefore, according to one aspect of the invention, there is provided a drill rod assembly, comprising: an outer drill rod having a first externally threaded end and a second internally threaded end, the outer drill rod including: a first inner diameter and a second inner diameter, the second inner diameter being greater than the first inner diameter; and an internal shoulder located at a transition between the first and second inner diameters; an inner drill rod having a first and second hexagonal ends, the inner drill rod being positioned within the outer drill rod such that an annular fluid flow path is defined between the inner and outer drill rods, the inner drill rod including: an external shoulder sized to engage the internal shoulder of the outer drill rod to limit movement of the inner drill rod relative to the outer drill rod in a first longitudinal direction; and a coupling attached to the second end of the inner drill rod, the coupling having an outer diameter at a first end that exceeds the first inner diameter of the outer drill rod to limit movement of the inner drill rod relative to the outer drill rod in a second opposite longitudinal direction; wherein the coupling defines fluid flow passages that are in fluid communication with the annular fluid flow path when the coupling is seated against the outer drill rod.

According to another aspect of the invention, there is provided a drill rod assembly, comprising: an outer drill rod having a first externally threaded end and a second internally threaded end, the outer drill rod including: a first inner diameter and a second inner diameter, the second inner diameter being greater than the first inner diameter; and an internal shoulder located at a transition between the first and second inner diameters; an inner drill rod having a first and second hexagonal ends, the inner drill rod being positioned within the outer drill rod such that an annular fluid flow path is defined between the inner and outer drill rods, the inner drill rod including: an external shoulder sized to engage the internal shoulder of the outer drill rod to limit movement of the inner drill rod relative to the outer drill rod in a first longitudinal direction; and a coupling attached to the second end of the inner drill rod, the coupling having an outer diameter that exceeds the first inner diameter of the outer drill rod to limit movement of the inner drill rod relative to the outer drill rod in a second opposite longitudinal direction; wherein the external shoulder of the inner drill rod defines fluid flow passages that are in fluid communication with the annular fluid flow path when the external shoulder of the inner drill rod is seated against the internal shoulder of the outer drill rod.

According to yet another aspect of the invention, there is provided a drill rod assembly, comprising: an outer drill rod having a first externally threaded end and a second internally threaded end; an inner drill rod having first male hexagonal end and a second end, the inner drill rod being positioned within the outer drill rod such that an annular fluid flow path is defined between the inner and outer drill rods; a coupling attached to the second end of the inner drill rod, the coupling having a female hexagonal end; wherein the inner drill rod defines a fluid flow passage, the fluid flow passage providing fluid communication between the annular fluid flow path defined by the inner and outer drill rods and another annular fluid flow path of a second drill rod assembly when the second drill rod is coupled to one of the first and second ends of the outer drill rod.

According to another aspect of the invention, there is provided a method of forming a drill rod, comprising: forming a first outer drill rod, the first outer drill rod having a first externally threaded end and a second internally threaded end, the first outer drill rod further including: a first inner diameter and a second inner diameter, the second inner diameter being greater than the first inner diameter; and an internal shoulder located at a transition between the first and second inner diameters; forming a first inner drill rod, the first inner drill rod having a first and a second hexagonal end, the first inner drill rod being positioned within the first outer drill rod, wherein an annular fluid flow path is defined between the first inner and first outer drill rod; forming an external shoulder on the first inner drill rod, the external shoulder arranged and configured to engage the internal shoulder of the first outer drill rod to limit movement of the first inner drill rod relative to the first outer drill rod in a first longitudinal direction; and attaching a coupling to the second end of the first inner drill rod, the coupling having an outer diameter at a first end that exceeds the first inner diameter of the first outer drill rod to limit movement of the first inner drill rod relative to the first outer drill rod in a second opposite longitudinal direction, wherein the coupling defines fluid flow passages that are in fluid communication with the annular fluid flow path when the coupling is seated against the outer drill rod.

Another aspect of the invention provides for a method of forming a drill string, comprising: forming first and a second outer drill rods, the first and second outer drill rods each having a first externally threaded end and a second internally threaded end, the first and second outer drill rods further including: a first inner diameter and a second inner diameter, the second inner diameter being greater than the first inner diameter; and an internal shoulder located at a transition between the first and second inner diameters; forming first and second inner drill rods, the first and second inner drill rods having a first and a second hexagonal end, the first and second inner drill rods being positioned within the first and second outer drill rods, respectively, wherein an annular fluid flow path is defined between the first inner and first outer drill rod and the second inner and second outer drill rod; forming an external shoulder on each of the first and second inner drill rod, the external shoulder arranged and configured to engage the internal shoulder of the first and second outer drill rods, respectively, to limit movement of the first and second inner drill rods relative to the first and second outer drill rods in a first longitudinal direction; attaching a coupling to the second end of the first and second inner drill rods, the coupling having an outer diameter at a first end that exceeds the first inner diameter of the first and second outer drill rods to limit movement of the first and second inner drill rods relative to the first and second outer drill rods in a second opposite longitudinal direction, wherein the coupling defines fluid flow passages that are in fluid communication with the annular fluid flow path when the coupling is seated against the outer drill rod; and attaching the first inner drill rod to the second inner drill rod and attaching the first outer drill rod to the second outer drill rod, whereby a drill string is formed.

While the invention will be described with respect to preferred embodiment configurations and with respect to particular devices used therein, it will be understood that the invention is not to be construed as limited in any manner by either such configuration or components described herein. While particular drill pipes are described herein, the principles of this invention extend to any environment in which minimizing and/or eliminating fluid flow restrictions in a drill string. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

Referring to the drawings, wherein like numerals represent like parts throughout the several views.

DETAILED DESCRIPTION

FIGS. 5-27 illustrate various embodiments of drill rod assemblies having features that are examples of how inventive aspects in accordance with the principles of the present disclosure may be practiced. Preferred features are adapted for preventing blockage of a fluid flow path through a drill string formed by the interconnection of the drill rod assemblies.

Figure 1:
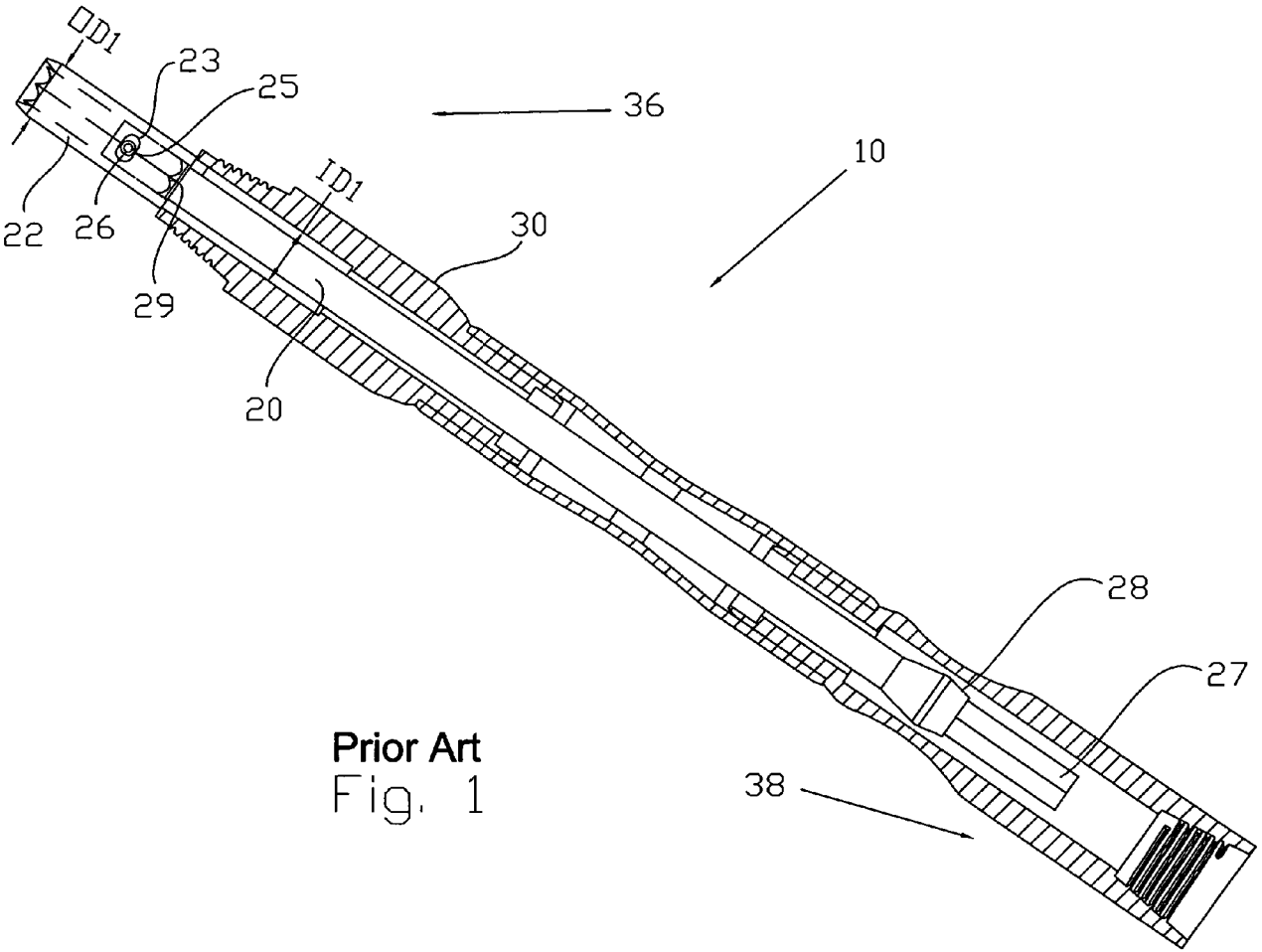
Prior Art Fig. 1
FIG. 1 is a cross-sectional view of a prior art drill rod assembly having inner and outer drill rods.
Figure 2:
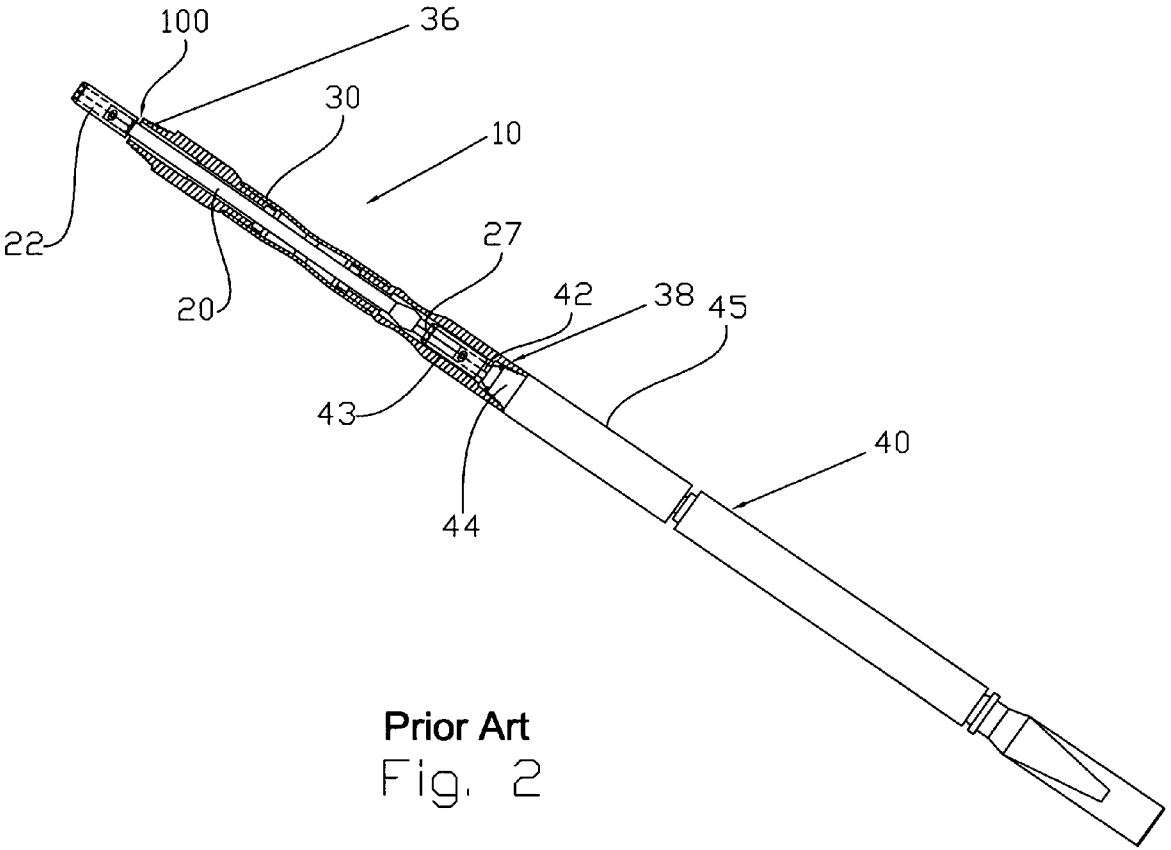
Prior Art Fig. 2
FIG. 2 is cross-sectional view of a drill string including the assembly of FIG. 1, and a boring tool installed on an end of the assembly.
Figure 3:
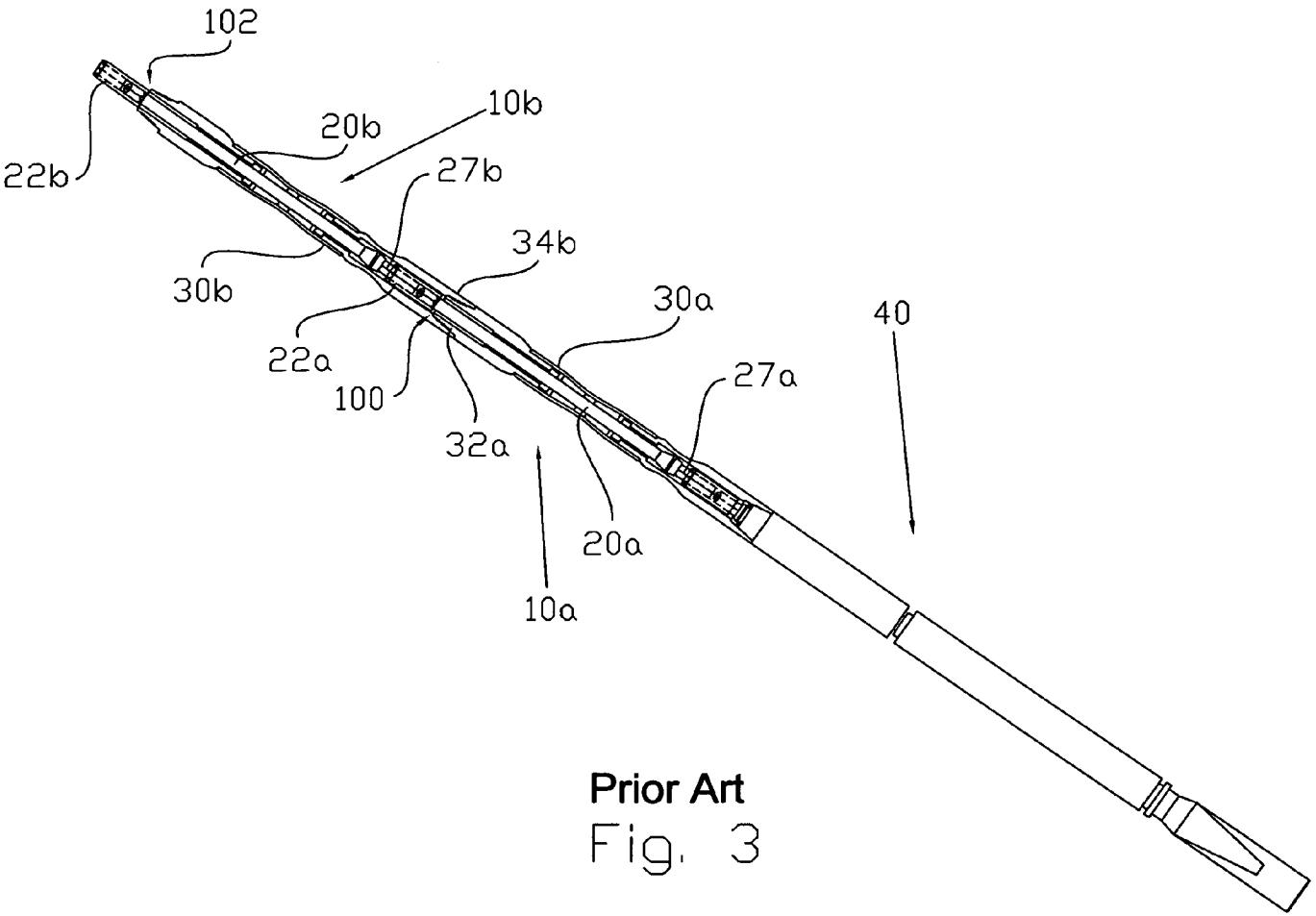
Prior Art Fig. 3
FIG. 3 is a cross-sectional view of the drill string of FIG. 2, including two drill rod assemblies.
Figure 4:
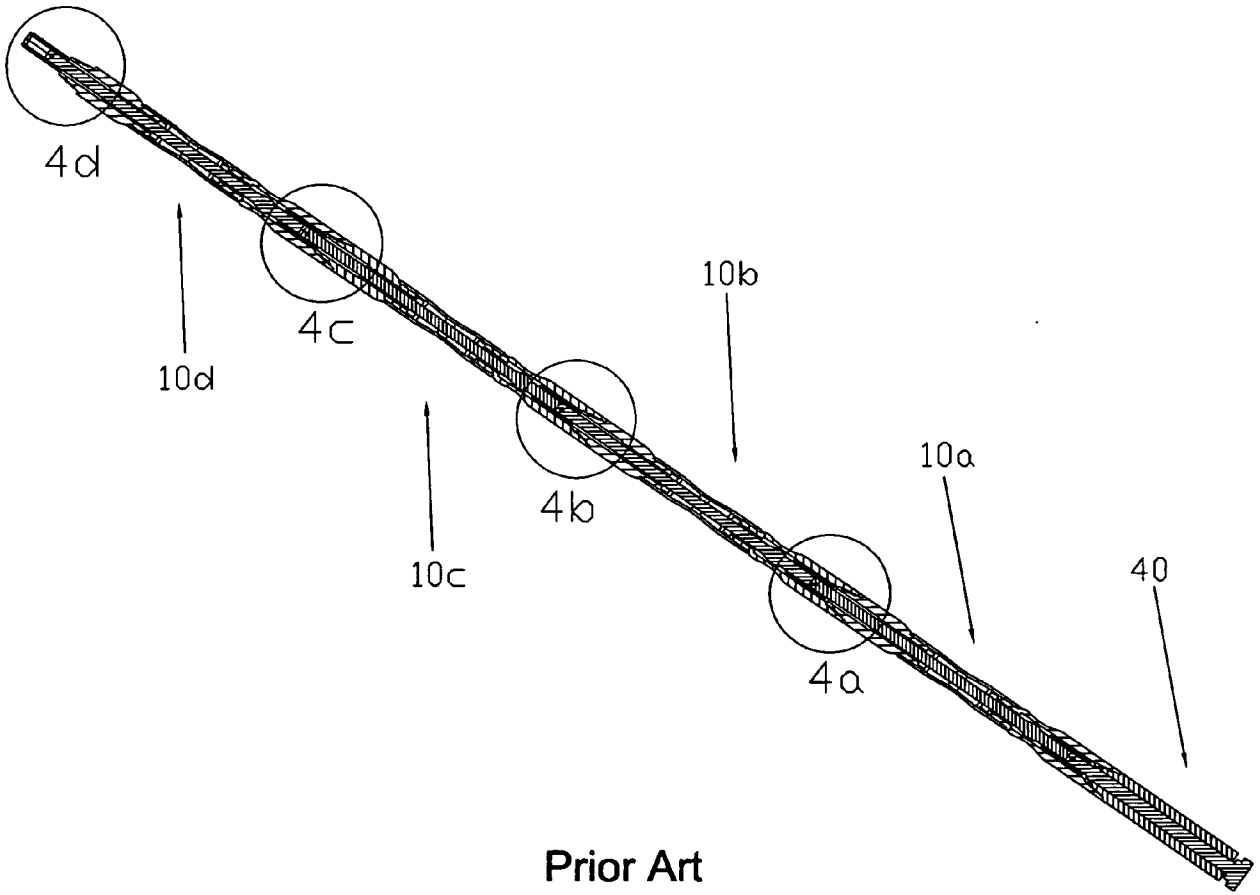
Prior Art Fig. 4
FIG. 4 is a cross-sectional view of the drill string of FIG. 3, including four drill rod assemblies.
Figure 4A:
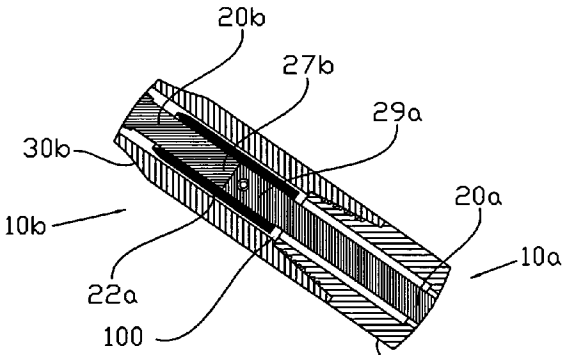
Prior Art Fig. 4a
FIG. 4*a* is an enlarged view of a first interconnection between the drill rod assemblies of the drill string of FIG. 4.
Figure 4B:
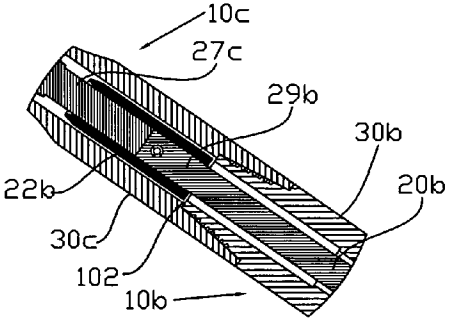
Prior Art Fig. 4b
FIG. 4*b* is an enlarged view of a second interconnection between the drill rod assemblies of the drill string of FIG. 4.
Figure 4C:
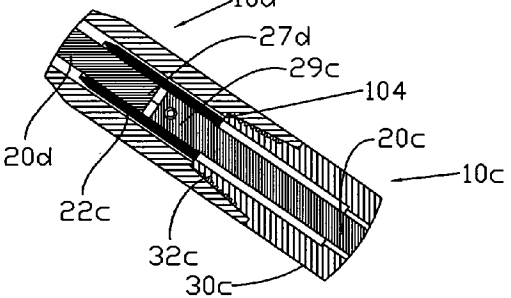
Prior Art Fig. 4c
FIG. 4*c* is an enlarged view of a third interconnection between the drill rod assemblies of the drill string of FIG. 4.
Figure 4D:
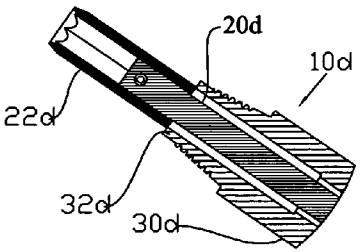
Prior Art Fig. 4d
FIG. 4*d* is an enlarged view of a fourth interconnection between the drill rod assemblies of the drill string of FIG. 4.
Figure 5:
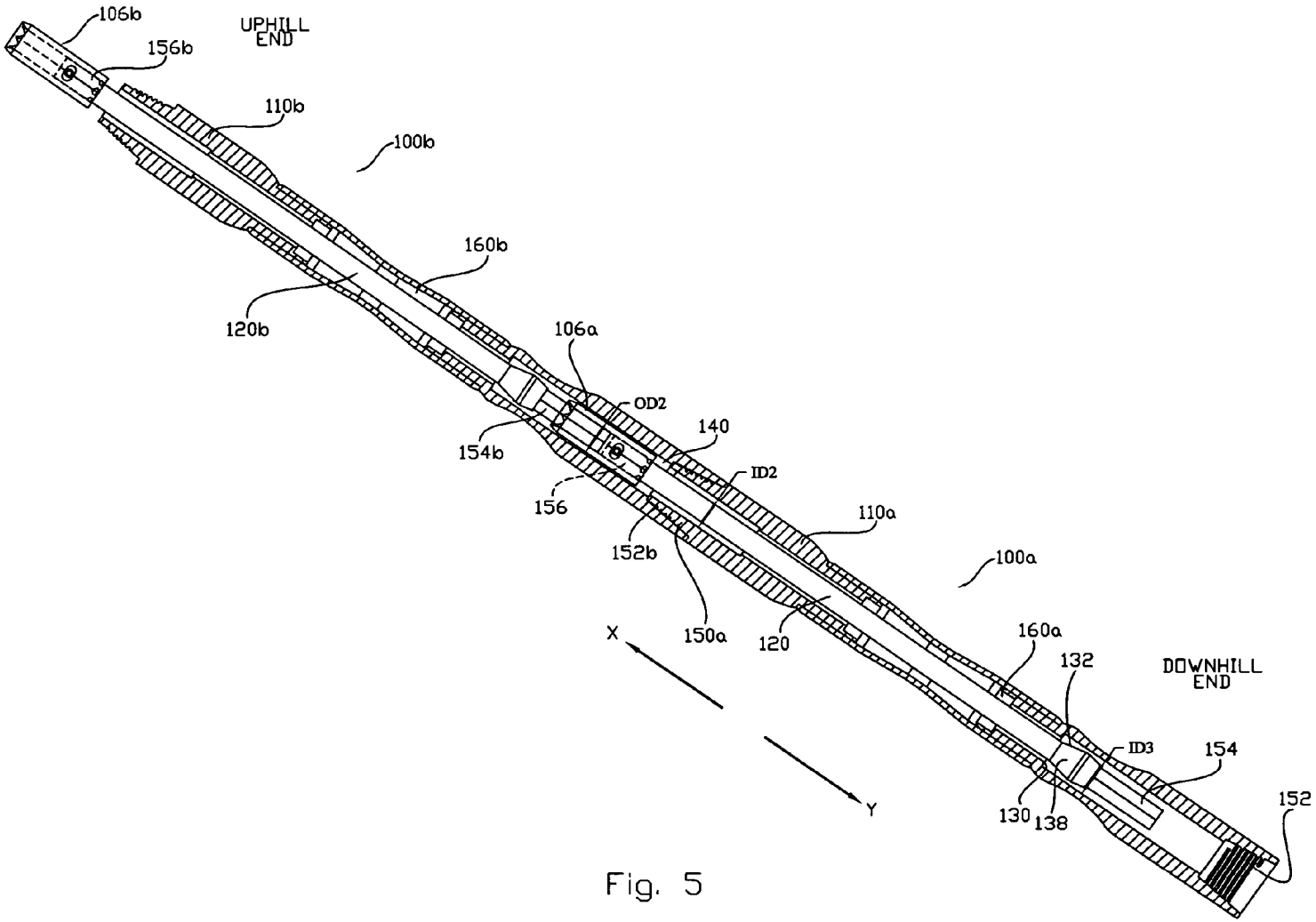
FIG. 5 is a cross-sectional view of a drill string, including first and second drill rod assemblies of a first drill rod assembly embodiment, the first and second drill rod assemblies being constructed in accordance with the principles disclosed.

Referring first to FIG. 5, a drill string made up of two drill rod assemblies 100 is illustrated. The two drill rod assemblies 100 include a down-hill drill rod assembly and an up-hill drill rod assembly. Each of the down-hill and up-hill assemblies 100 includes identical components. Wherever possible, the same reference numbers are used through the drawings to refer to the same or like components, however, subscripts of 'a' and 'b' are used to identify the components of the particular down-hill or up-hill rod assembly, respectively. This same reference numbering scheme is used throughout the description of the various embodiments of the present disclosure.

Each of the outer drill rod assemblies 100 of FIG. 5 includes an outer drill rod 110 having a first externally threaded end 150 and a second internally threaded end 152. The drill rod assemblies 100 each further include an inner drill rod 120 having a first hexagonal end 154 and a second hexagonal end 156. The inner drill rod 120 is positioned within the outer drill rod 110 such that an annular fluid flow path 160 is defined between the inner and outer drill rods 120, 110. A coupling 106 is attached to the second hexagonal end 156 of the inner drill rod 120.

To create the drill string, the internally threaded end 152*b* of the up-hill outer drill rod 110*b* is threaded to the externally threaded end 150*a* of the down-hill outer drill rod 110*a*. At the same time, the first hexagonal end 154*b* of the up-hill inner drill rod 120*b* is received within corresponding structure of the down-hill coupling 106*a*.

Still referring to FIG. 5, the outer drill rod 110 defines a first inner diameter ID2 and a second larger inner diameter ID3. An internal shoulder 130 is located at a transition between the first and second inner diameters ID2, ID3. The inner drill rod 120 includes an enlarged portion 138 that defines an external shoulder 132. The external shoulder 132 of the enlarged portion 138 engages the internal shoulder 130 of the outer drill rod 110 to limit movement of the inner drill rod 120 relative to the outer drill rod 110 in an up-hill longitudinal direction (represented by arrow X).

The coupling 106 of the drill rod assembly 100 has an outer diameter OD2 that exceeds the first inner diameter ID2 of the outer drill rod 110. The larger outer diameter OD2 of the coupling 106 limits movement of the inner drill rod 120 relative to the outer drill rod 110 in a down-hill longitudinal direction (represented by arrow Y).

This first drill rod assembly embodiment of FIG. 5 is adapted to prevent blockage of the fluid flow path through the drill string. The fluid flow path of the drill string is generally defined by the annular fluid flow paths 160 of the interconnected drill rod assemblies 100. The drill rod assembly 100 includes a number of passages 140 (best seen in FIG. 6) that further define the fluid flow path of the drill string. The passages 140 prevent a situation where flow between the annular flow path 160*b* (FIG. 5) of an up-hill drill rod assembly and the annular flow path (160*a*) of a down-hill drill rod assembly is blocked.

Figure 6:
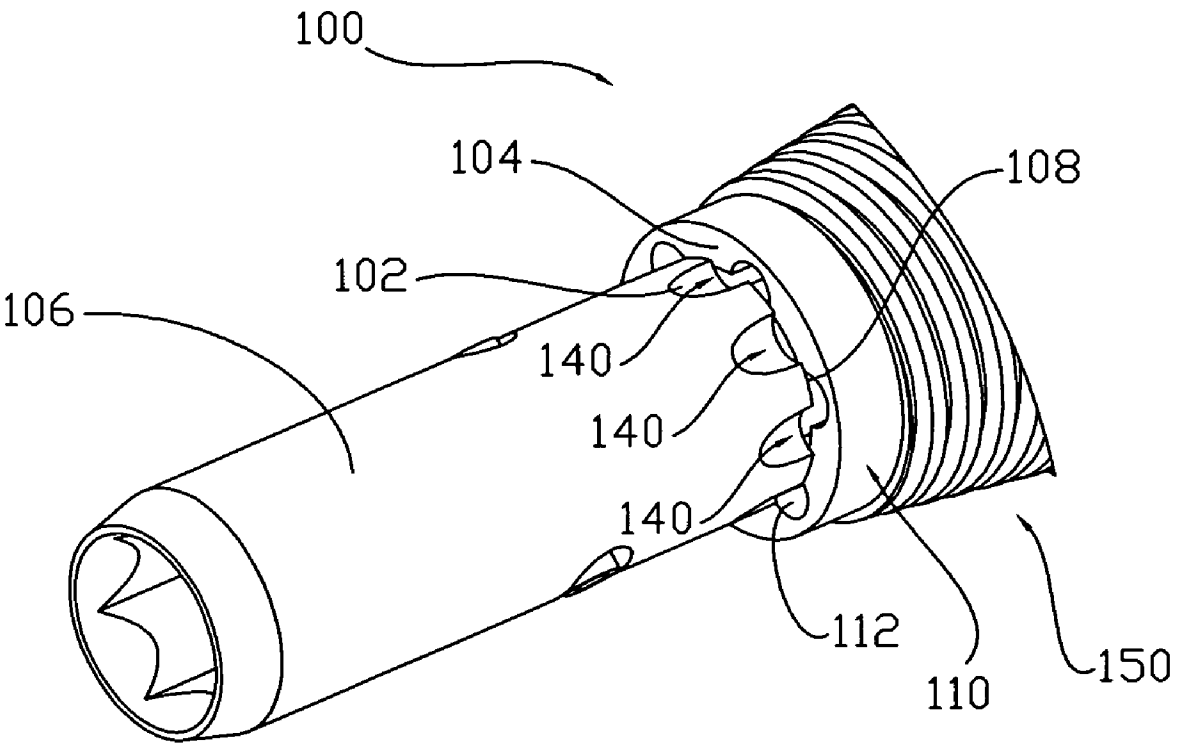
FIG. 6 is a partial perspective view of an up-hill end of one of the first drill rod assemblies of FIG. 5, showing a first embodiment of fluid flow passages.
Figure 7:
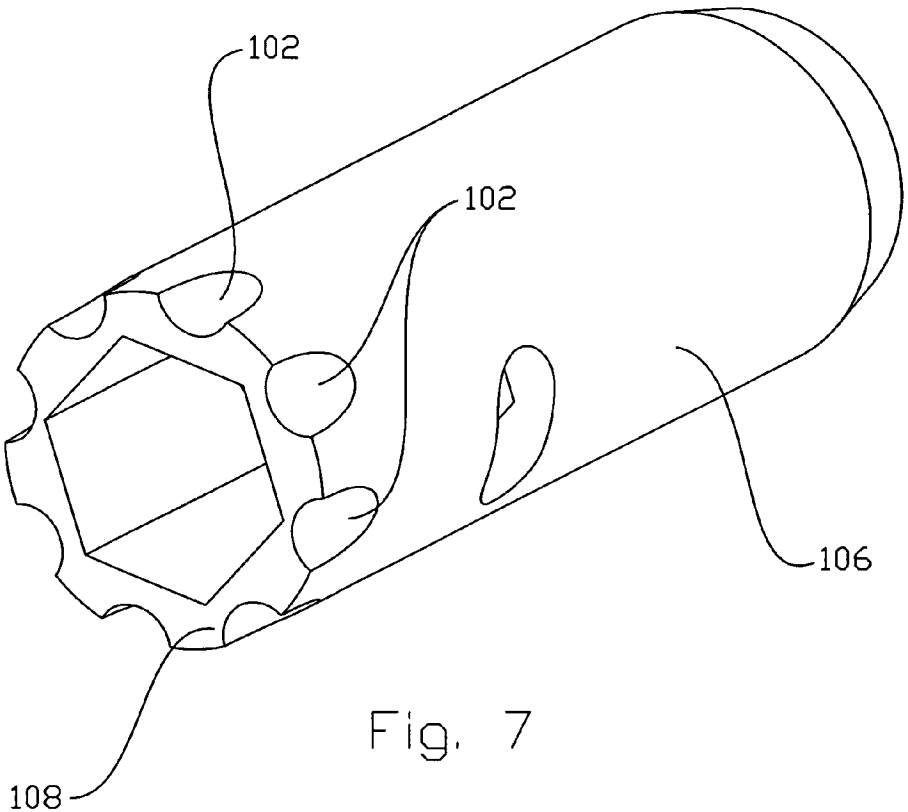
FIG. 7 is a perspective down-hill view of a coupling of the assembly of FIG. 6, shown in isolation.
Figure 8:
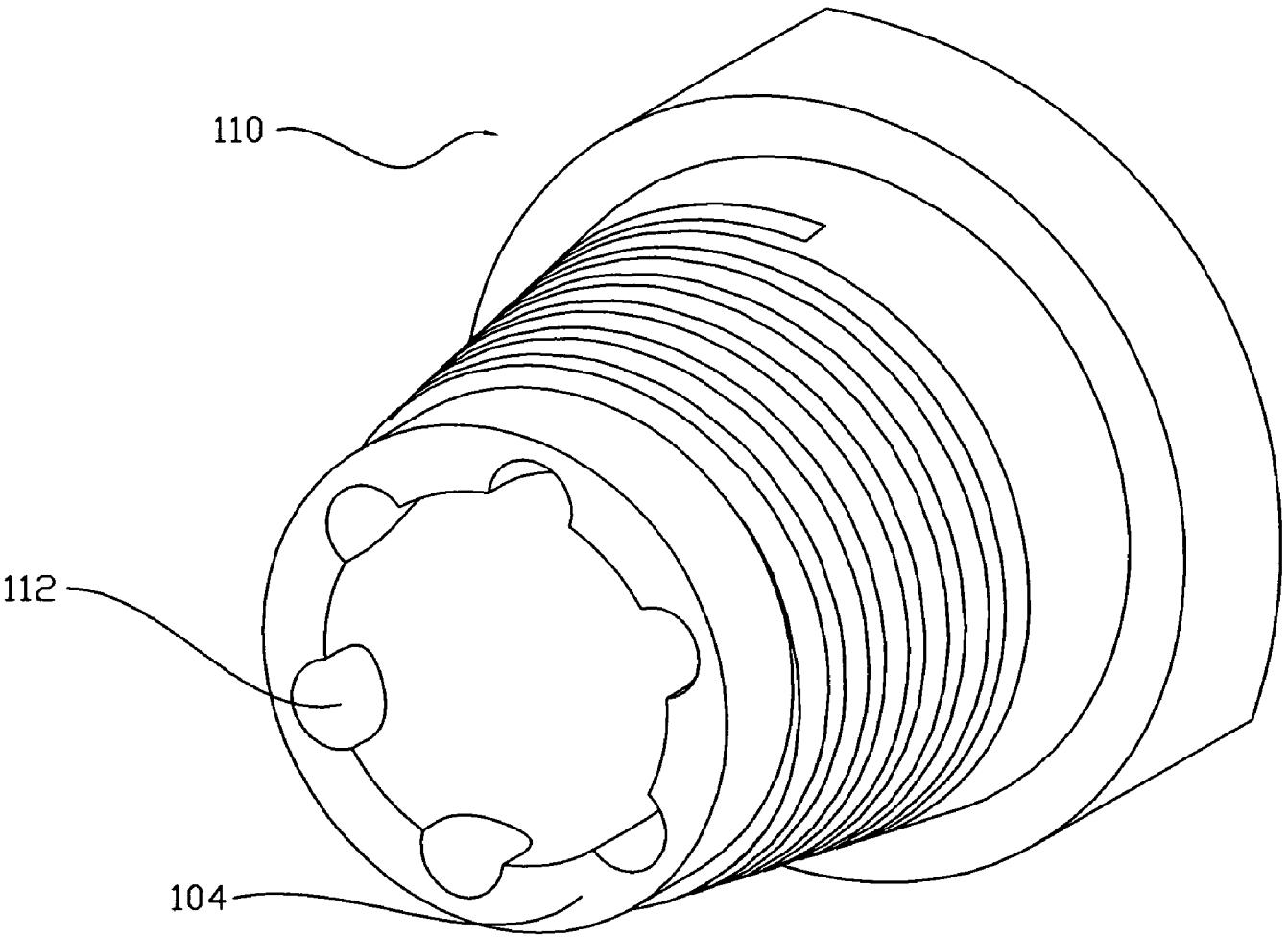
FIG. 8 is a partial perspective up-hill view of an outer drill rod of the assembly of FIG. 6, shown in isolation.

Referring now to FIGS. 6-8, the passages 140 of the drill rod assembly 100 include fluid flow slots 102 formed in a bearing surface 108 of the coupling 106. The fluid flow slots 102 cooperate with slots 112 formed in a bearing surface 104 of the outer drill rod 110 to define the passages 140 that prevent flow blockage.

Although no specific number of fluid flow slots 102 in the coupling 106 is required, preferably, the number of slots 102 balances the need for an adequate cross-sectional flow area with the need for adequate structural area of the bearing surface 108. That is, the number of fluid flow slots 102 in the coupling 106 preferably maximizes fluid flow, without jeopardizing the structural strength of the bearing surface 108 of the coupling 106. Likewise, no specific number of slots 112 in the outer drill rod 110 is required. Yet, preferably, the number of slots 112 balances the need for an adequate cross-sectional flow area with the need for adequate structural area of the bearing surface 104. That is, the number of slots 112 in the outer drill rod 110 preferably maximizes fluid flow, without jeopardizing the structural strength of the bearing surface 104 of the outer drill rod 110. In the illustrated embodiment, the coupling 106 includes eight fluid flow slots 102 (FIG. 7), and the outer drill rod 110 includes six slots 112 (FIG. 8).

Figure 9:
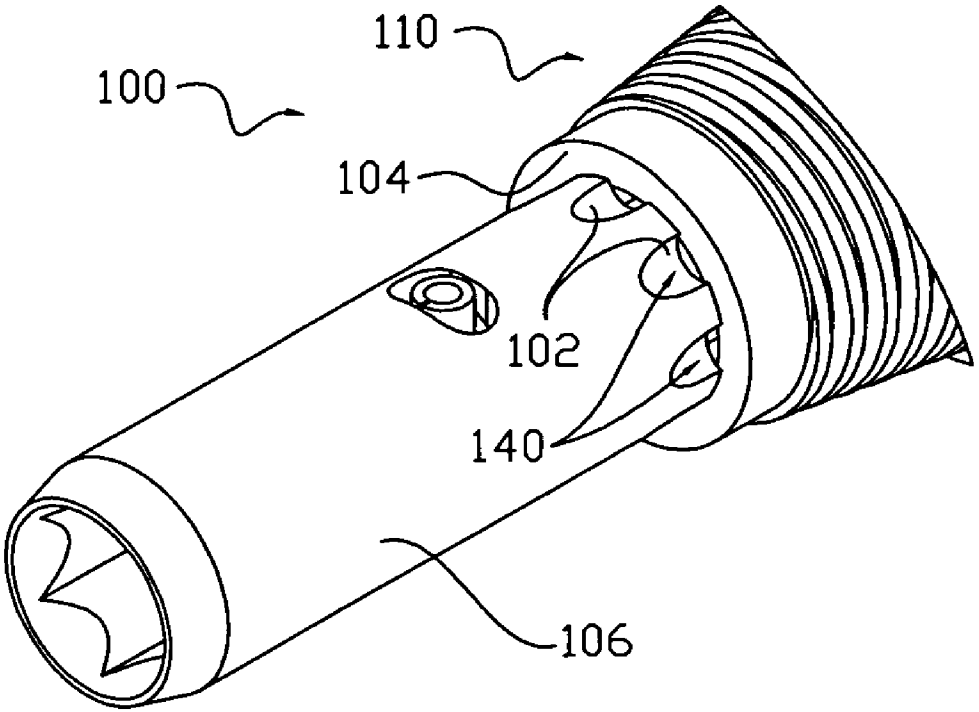
FIG. 9 is a partial perspective view of an up-hill end of a drill rod assembly, similar to the drill rod assembly embodiment illustrated in FIG. 5, showing a second embodiment of fluid flow passages.
Figure 10:
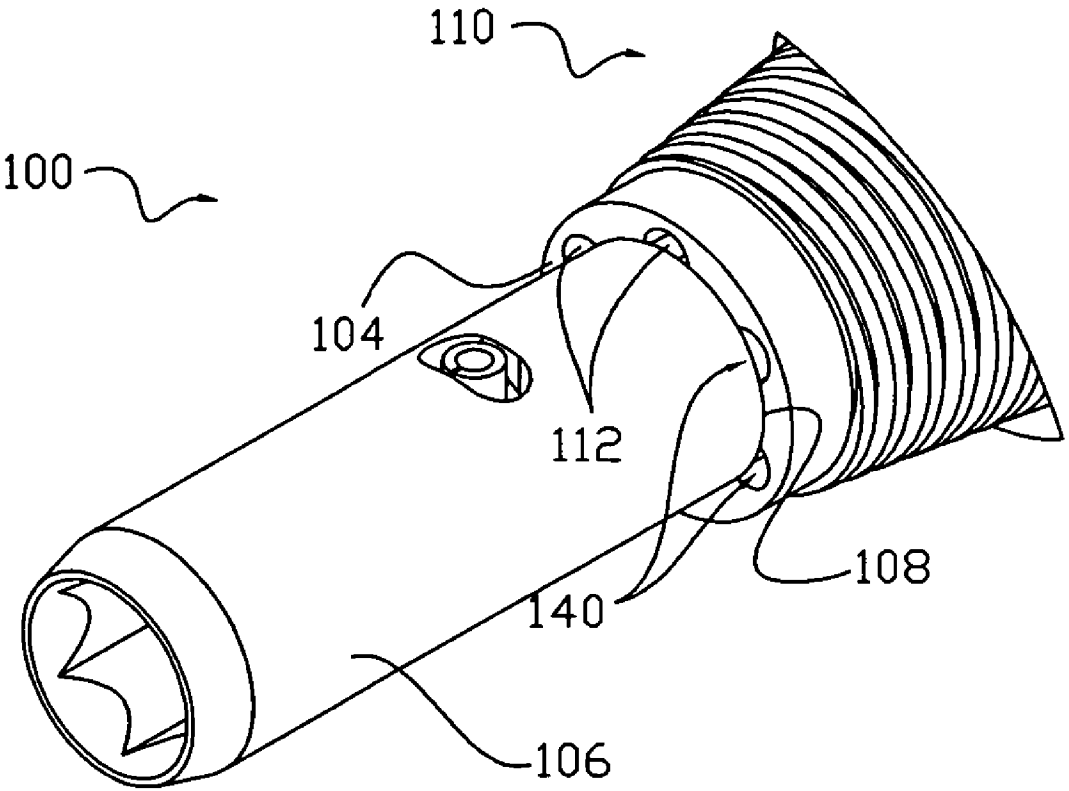
FIG. 10 is a partial perspective view of an up-hill end of a drill rod assembly, similar to the drill rod assembly embodiment illustrated in FIG. 5, showing a third embodiment of fluid flow passages.
Figure 11:
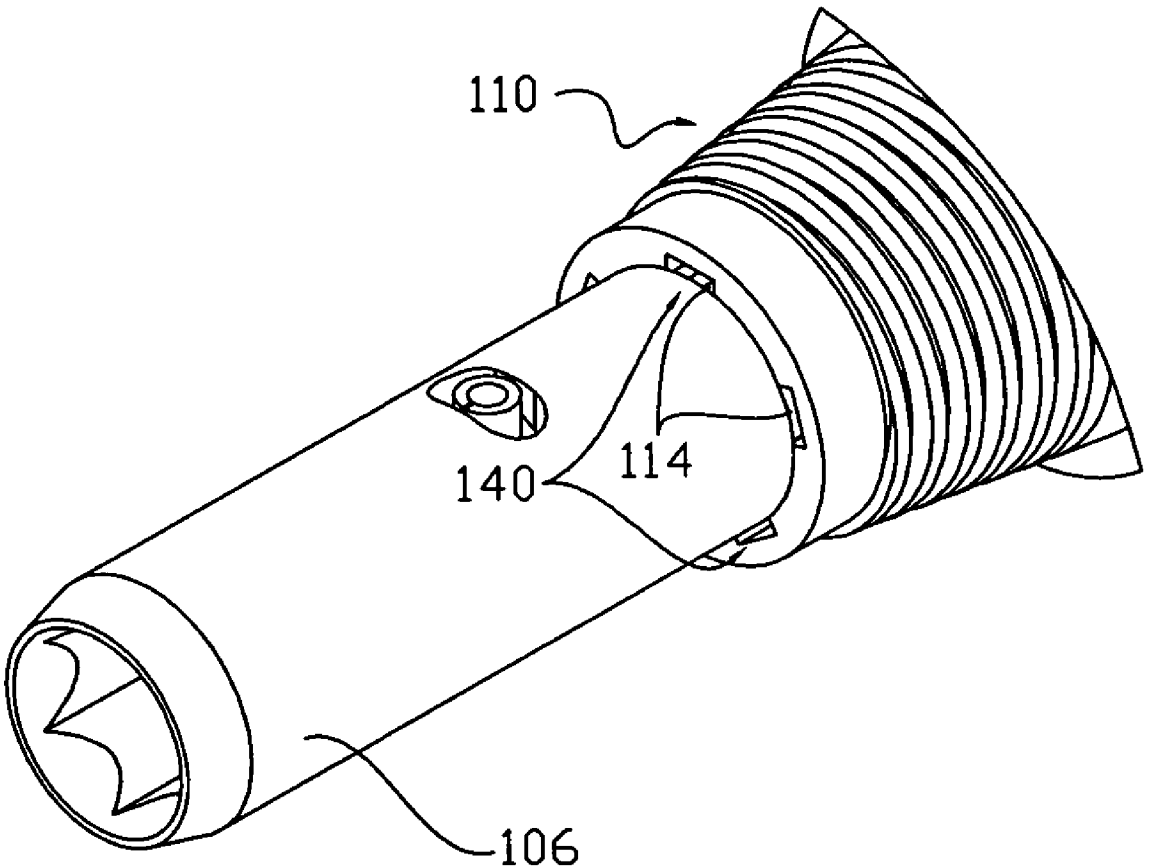
FIG. 11 is a partial perspective view of an up-hill end of a drill rod assembly, similar to the drill rod assembly embodiment illustrated in FIG. 5, showing a fourth embodiment of fluid flow passages.
Figure 12:
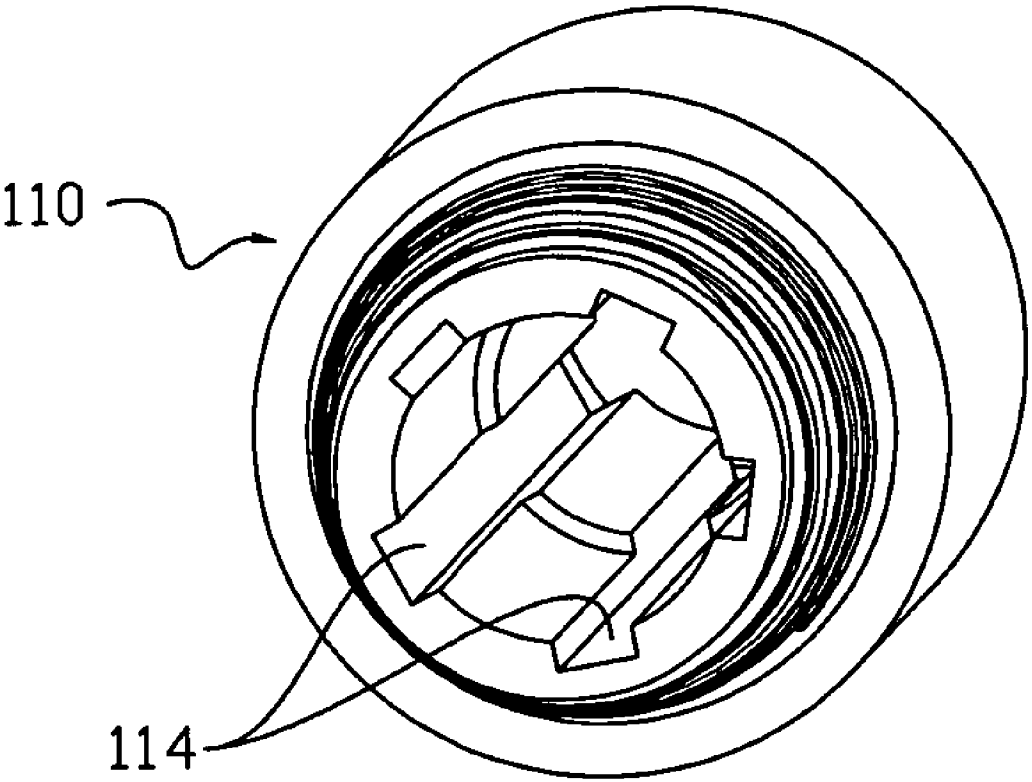
FIG. 12 is a partial perspective up-hill view of an outer drill rod of the assembly of FIG. 11, shown in isolation.

In an alternative embodiment, as shown in FIG. 9, the drill rod assembly 100 includes fluid flow slots 102 formed only in the coupling 106. There are no slots formed in the bearing surface 104 of the outer drill rod 110. The fluid flow slots 102 of the coupling 106 are sized and oriented such that the passages 140 communicate directly with the inner diameter ID3 (FIG. 5) of the outer drill rod 110. Similarly, in yet another alternative embodiment, the drill rod assembly includes slot 112 formed only in the bearing surface 104 of the outer drill rod 110 (FIG. 10). Referring to FIG. 10, there are no slots formed in the bearing surface 108 of the coupling 106. The slots 112 of the outer drill rod 110 are sized and oriented such that the passages 140 communicate directly with the annular flow path (e.g., 160*b*) of an up-hill drill rod assembly.

While each of the passages 140 defined by either one or both of the slots 102, 112 of the coupling 106 and the outer drill rod 110 is cylindrical in form, other shaped passages can be provided. For example, in FIGS. 11 and 12, the outer drill rod 110 of the drill rod assembly defines passages 140 formed by splines or slots 114 having a generally square shape.

Figure 13:
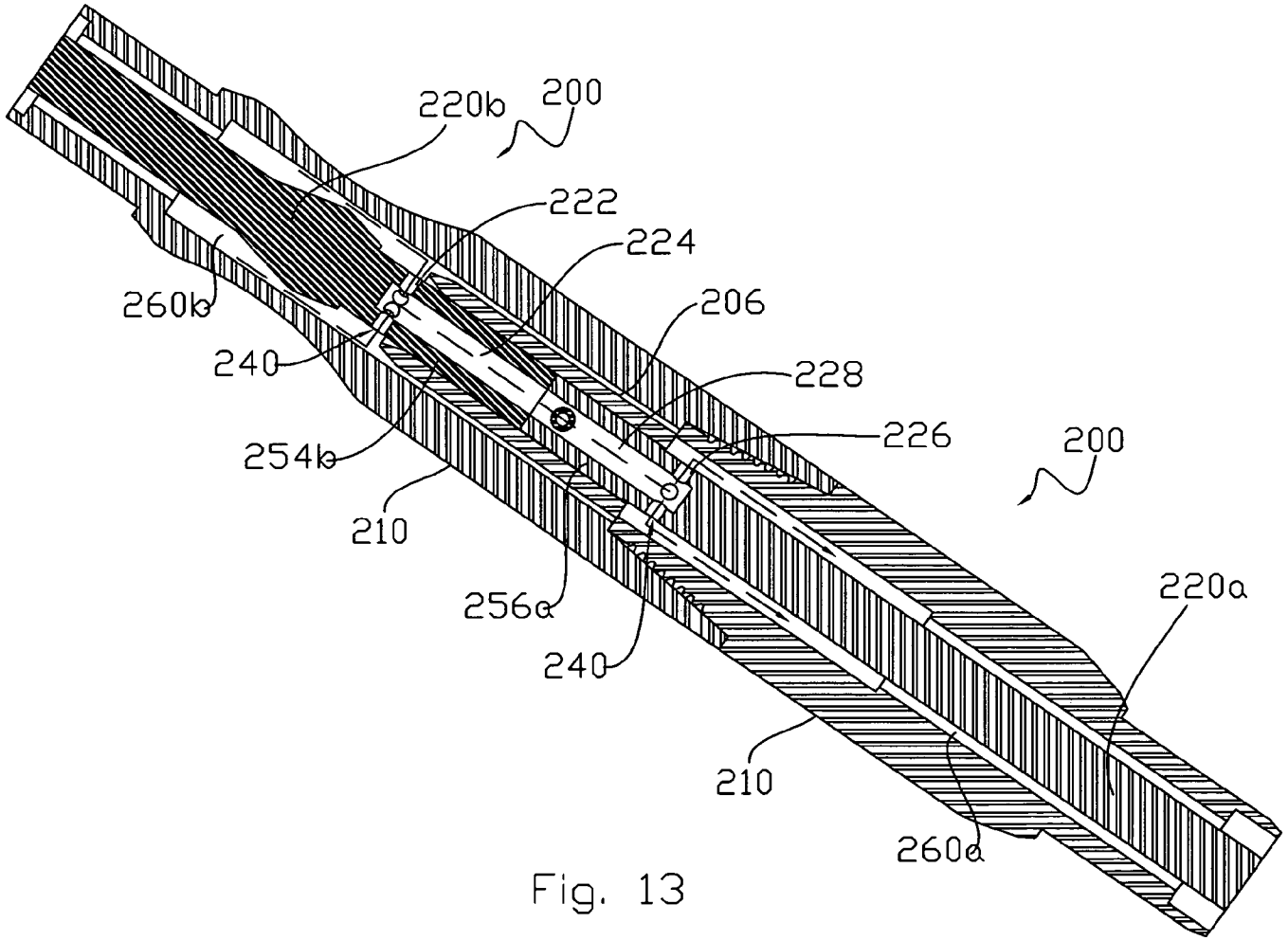
FIG. 13 is a cross-sectional view of a drill string, including first and second drill rod assemblies of a second drill rod assembly embodiment, the first and second drill rod assemblies being constructed in accordance with the principles disclosed.

FIG. 13 illustrates drill rod assemblies 200 of a second embodiment, the drill rod assemblies 200 being interconnected to form a drill string. Similar to the previous embodiment of FIG. 5, each of the drill rod assemblies 200 includes an outer drill rod 210, an inner drill rod 220, and a coupling 206 that is attached to the inner drill rod 220. This second drill rod assembly 200 is also adapted to prevent blockage of the fluid flow path through the drill string. In particular, the drill rod assembly 200 includes passage 240 that prevent a situation where flow between the annular flow path 260*b* of an up-hill drill rod assembly and the annular flow path 260*a* of a down-hill drill rod assembly is blocked.

Figures 14, 15:
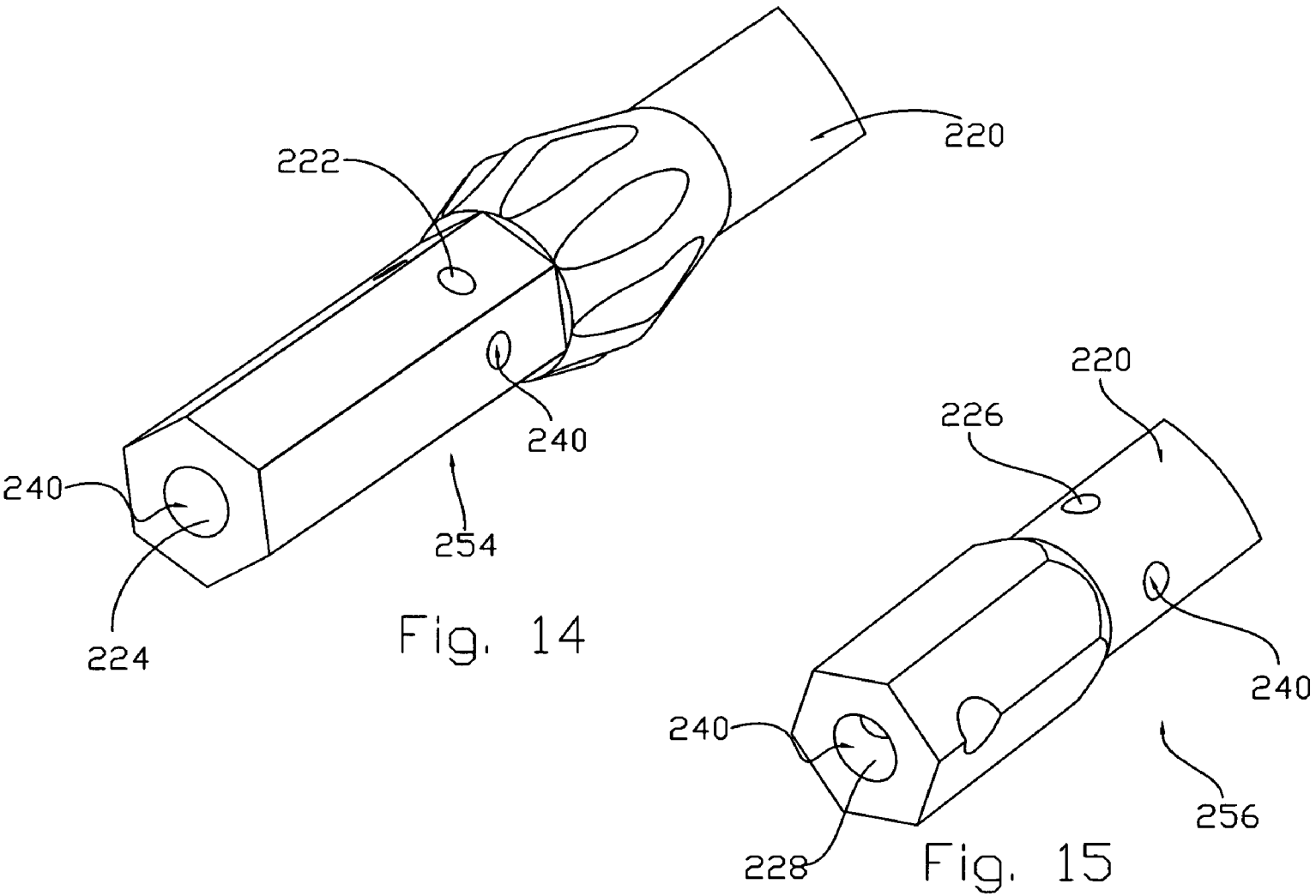
FIG. 14 is a partial perspective view of a down-hill end of an inner drill rod of the second drill rod assembly embodiment of FIG. 13.
FIG. 15 is a partial perspective view of an up-hill end of the inner drill rod of the second drill rod assembly embodiment of FIG. 13.

In the embodiment of FIG. 13, the passages 240 are formed in each of the first and second ends 254, 256 of the inner drill rod 220. In particular, as shown in FIG. 14, cross-drilled holes 222 are formed in the first end 254 of the inner drill rod 220. The cross-drilled holes 222 are in fluid communication with a bore 224 located at the first end 254 of the inner drill rod 220. Referring to FIG. 15, cross-drilled holes 226 are likewise formed in the second end 256 of the inner drill rod 220. The cross-drilled holes 226 are in fluid communication with a bore 228 located at the second end 256 of the inner drill rod 220. With this arrangement, fluid passes through the bores 224, 228 from the first end 254*b* (FIG. 13) of the up-hill inner drill rod 220*b* to the second end 256*a* of the down-hill inner drill rod 220*a*, even when the coupling 206 is seated against the outer drill rod 210 of the down-hill assembly 200. That is, the present drill rod assembly 200 permits the coupling 206 to seat against the associated outer drill rod 210 without blocking the fluid flow path of the drill string.

Figure 16:
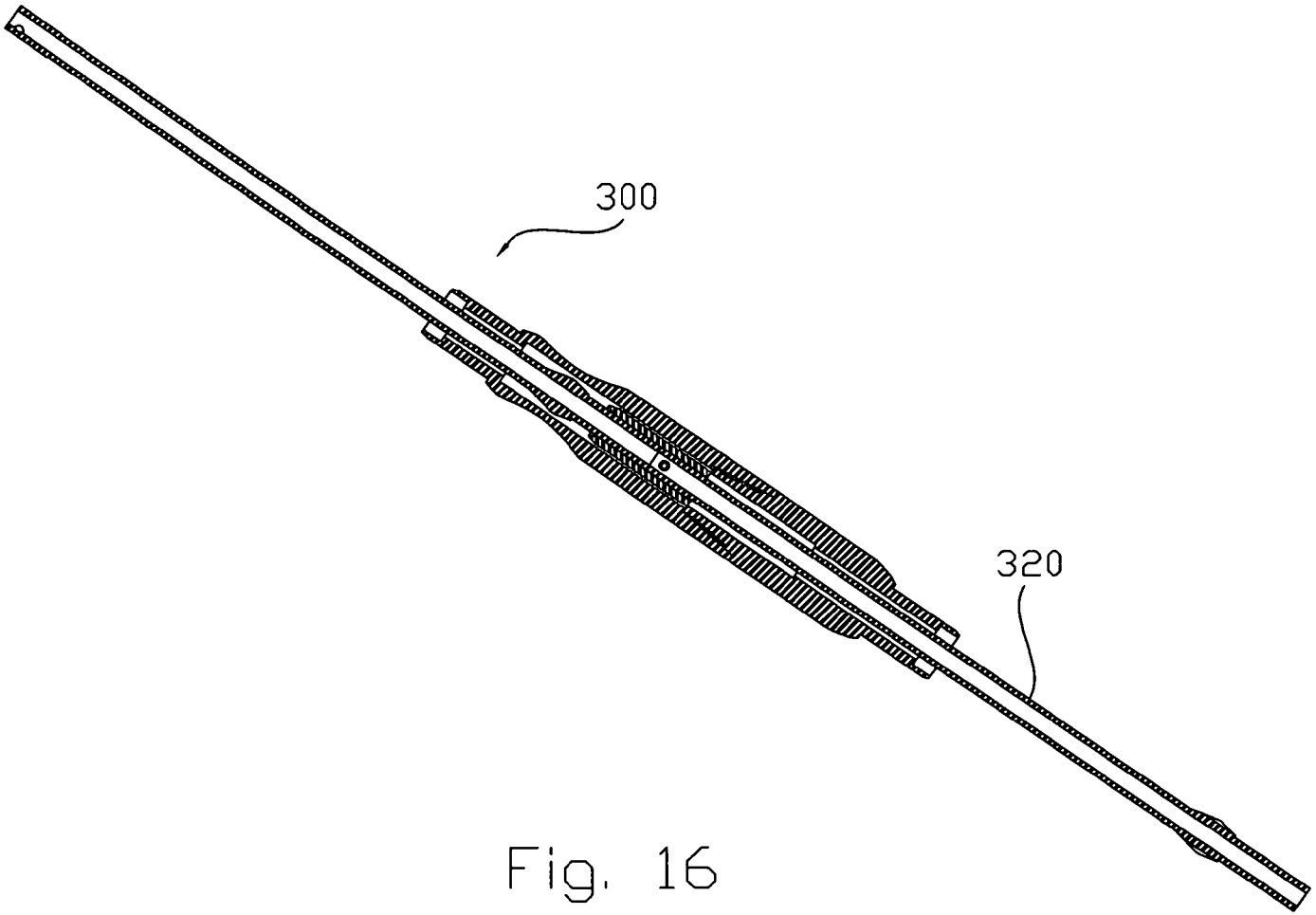
FIG. 16 is a cross-sectional view of a drill string, including partially shown first and second drill rod assemblies of a third drill rod assembly embodiment, the first and second drill rod assemblies being constructed in accordance with the principles disclosed.

FIG. 16 illustrates a third embodiment wherein the inner rod 320 includes a flow path through its entire length, eliminating the need for cross-drilled holes of the previous embodiment.

Figure 17:
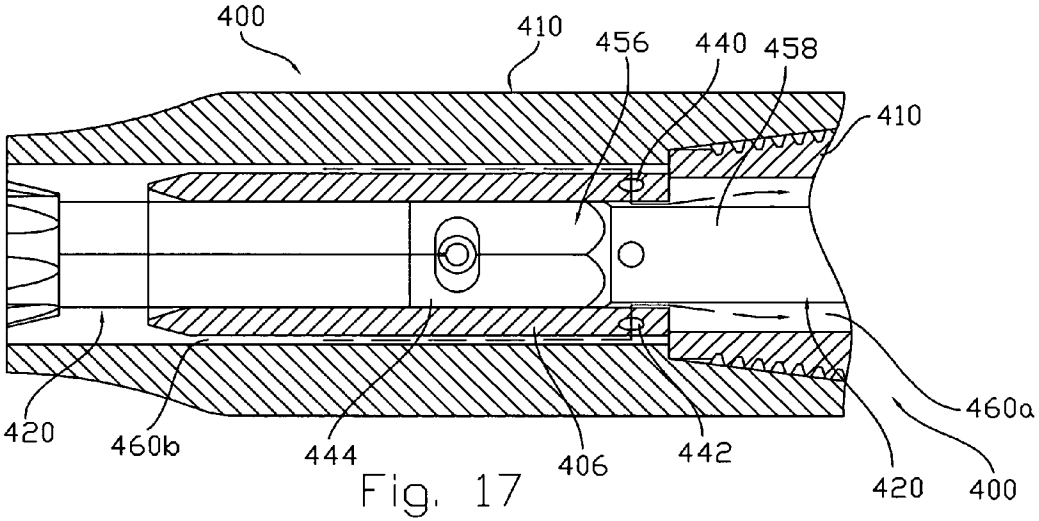
FIG. 17 is a cross-sectional view of a drill string, including partially shown first and second drill rod assemblies of a fourth drill rod assembly embodiment, the first and second drill rod assemblies being constructed in accordance with the principles disclosed.

FIG. 17 illustrates drill rod assemblies 400 of a fourth embodiment, the drill rod assemblies 400 being interconnected to form a drill string. Similar to the previous embodiments, each of the drill rod assemblies 400 includes an outer drill rod 410, an inner drill rod 420, and a coupling 406 that is attached to the inner drill rod 420. The fourth drill rod assembly 400 embodiment is also adapted to prevent blockage of the fluid flow path through the drill string. In particular, the drill rod assembly 400 includes passages 440 that prevent a situation where flow between the annular flow path 460*b* of an up-hill drill rod assembly and the annular flow path 460*a* of a down-hill drill rod assembly is blocked.

In the embodiment of FIG. 17, the passages 440 are defined by cross-drilled holes 442 formed in the coupling 406. The second end 456 of the inner drill rod 420 includes an offset hexagonal construction 444. The remaining portion 458 of the second end 456 of the inner drill rod that fits within the coupling 406 is round. When the coupling 406 is affixed to the inner drill rod 420, the round portion 458 of the second end 456 of drill rod 420 generally aligns with the cross-drilled holes 442. Fluid flows through the passages 440 defined by the holes 442 and around the round portion 458 of the inner drill rod and into the annular fluid flow path 460*a* of the down-hill assembly 400. In the illustrated embodiment, as shown in FIG. 18, the passages 440 formed in the coupling 406 are defined by six cross-drilled holes 442; although other numbers of holes 442 can be provided.

Figure 18:
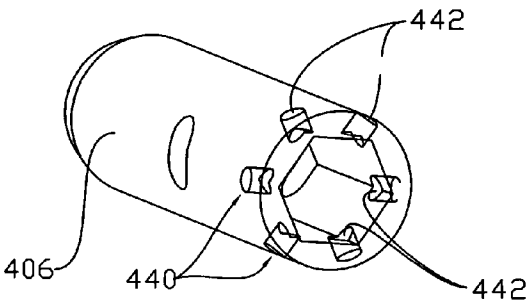
FIG. 18 is a perspective down-hill view of a coupling of the fourth drill rod assembly embodiment of FIG. 17, shown in isolation, and illustrating a first embodiment of fluid flow passages.
Figure 19:
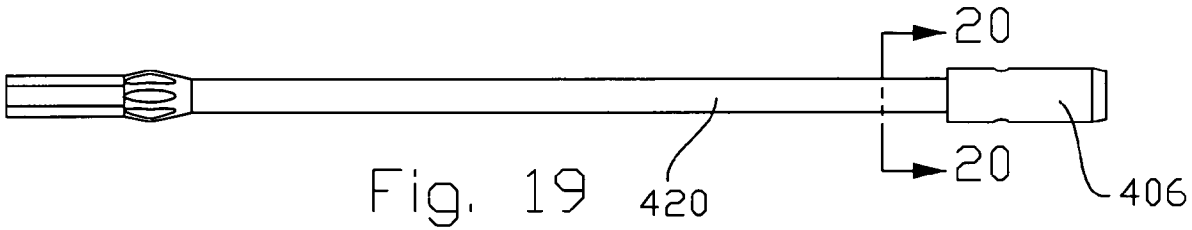
FIG. 19 is a side elevation view of a coupling and an inner drill rod of a drill rod assembly similar to the fourth drill rod assembly embodiment of FIG. 17, having a second embodiment of fluid flow passages.
Figure 20:
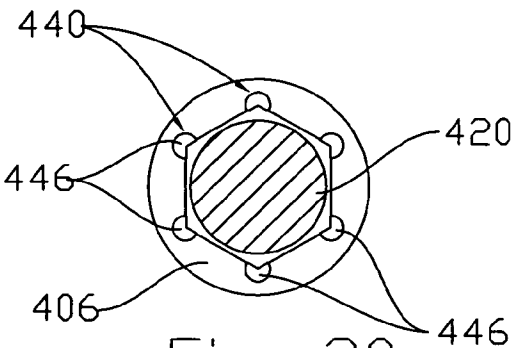
FIG. 20 is a cross-sectional view of the coupling and inner drill rod of FIG. 19, taken along line 20-20.
Figure 21:
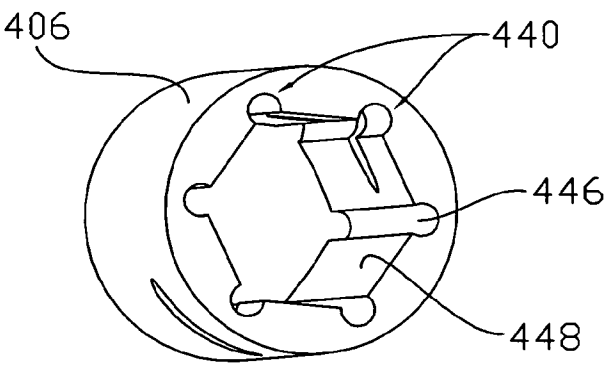
FIG. 21 is a perspective down-hill view of the coupling of FIG. 19, shown in isolation.
Figure 22:
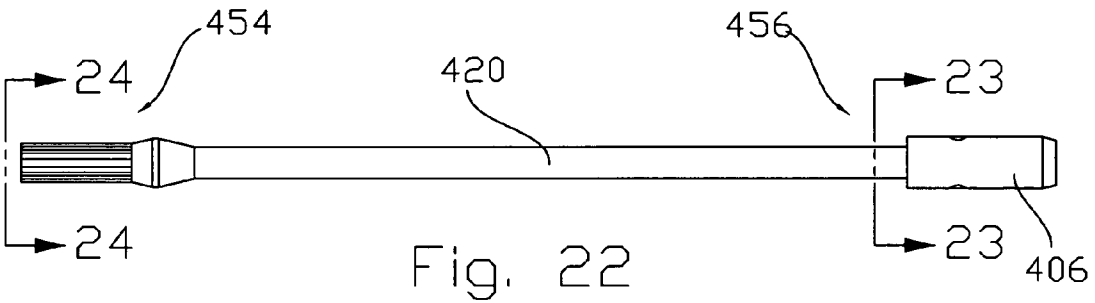
FIG. 22 is a side elevation view of a coupling and an inner drill rod of a drill rod assembly similar to the fourth drill rod assembly embodiment of FIG. 17, having a third embodiment of fluid flow passages.
Figure 23:
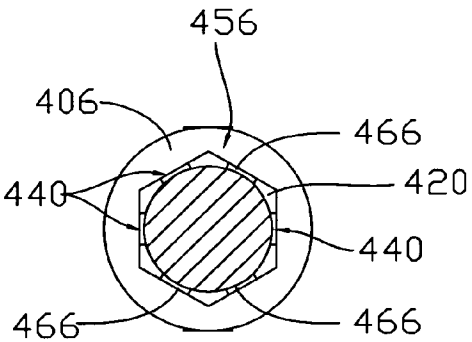
FIG. 23 is a cross-sectional view of the coupling and inner drill rod of FIG. 22, taken along line 23-23.

In an alternative coupling embodiment of the fourth drill rod assembly embodiment 400, the coupling 406 of the drill rod assembly 400 can include passages 440 that longitudinally extend along the length of the coupling 406, as opposed to being radially oriented as shown in FIG. 18. Referring now to FIGS. 19-21, the passages 440 can be defined by reliefs (e.g., clearance bores or clearance notches) 446 formed along the length of the hexagonal inner bore 448 of the coupling 406.

Figure 24:
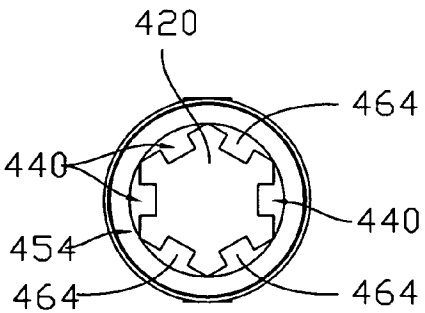
FIG. 24 is an elevation end view the coupling and inner drill rod of FIG. 22, taken from line 24-24.

In still another alternative inner drill rod embodiment of this fourth drill rod assembly embodiment 400, the drill rod 420 can define the passages that prevent fluid flow blockage. In particular, referring to FIGS. 22-24, the inner drill rod 420 can include passages 440 formed in the first and second hexagonal ends 454 and 456 of the inner drill rod 420. As shown in FIG. 24, the passages 440 can be defined by slots 464 formed in the first hexagonal end 454 of the inner drill rod 420 and slots 466 (FIG. 23) formed in the second hexagonal end 456 of the inner drill rod.

Figure 25:
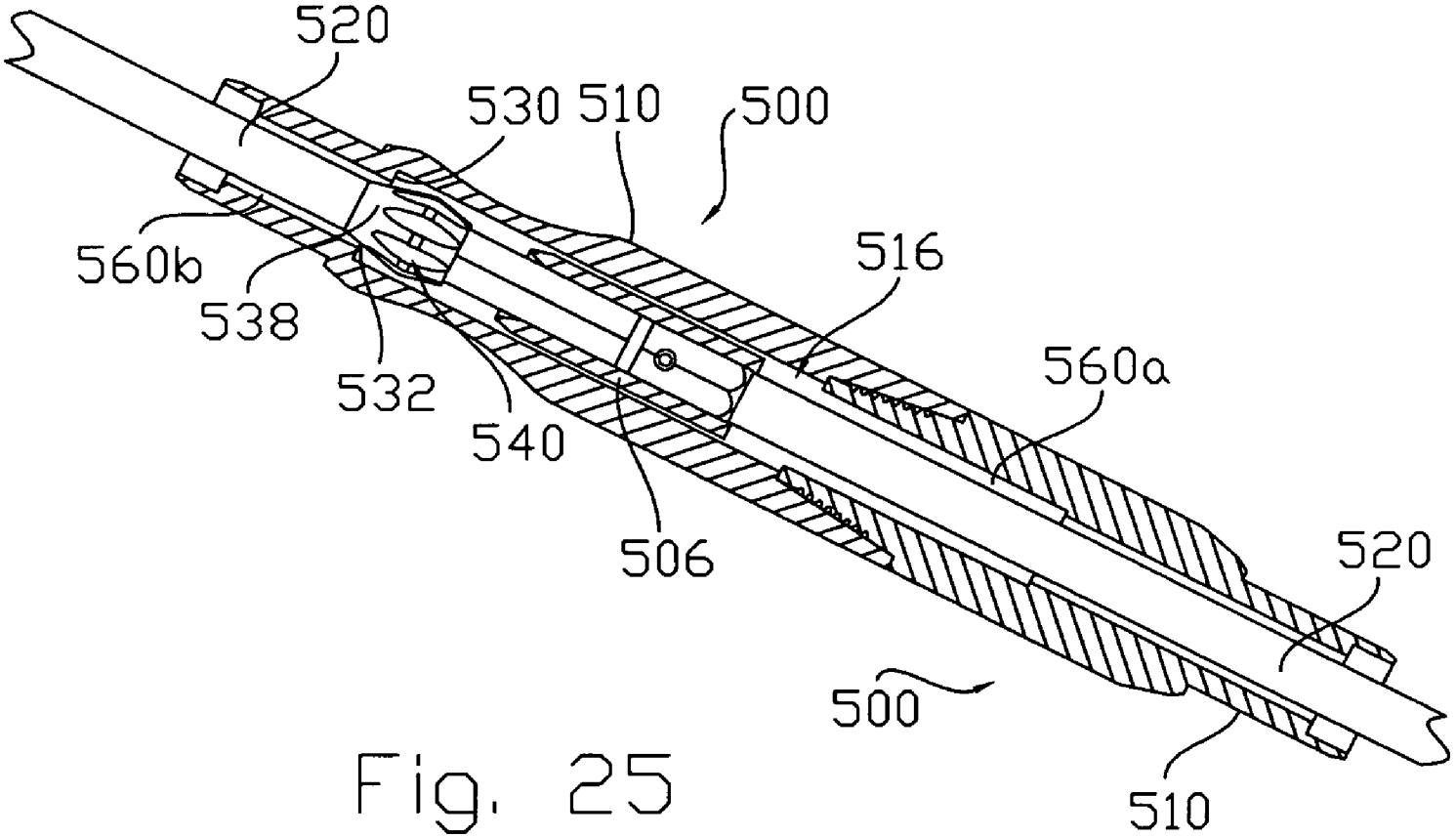
FIG. 25 is a cross-sectional view of a drill string, including partially shown first and second drill rod assemblies of a fifth drill rod assembly embodiment, the first and second drill rod assemblies being constructed in accordance with the principles disclosed.

Referring now to FIG. 25, drill rod assemblies 500 of a fifth embodiment are illustrated. Similar to the previous embodiments, each of the drill rod assemblies 500 includes an outer drill rod 510, an inner drill rod 520, and a coupling 506 that is attached to the inner drill rod 520. This fifth drill rod assembly embodiment 500 is adapted to prevent blockage of the fluid flow path through the drill string. In particular, the drill rod assembly 500 includes passage 540 that prevent a situation where flow between the annular flow path 560*b* of the up-hill drill rod assembly and the annular flow path 560*a* of the down-hill drill rod assembly is blocked.

In the embodiment of FIG. 25, the inner drill rod 520 is oriented in an up-hill position such that a gap 516 is provided between the coupler 506 and the outer drill rod 510. The gap 516 of a down-hill drill rod assembly 500 can cause the inner drill rod 520 of the up-hill drill rod assembly to contact the outer drill rod 510. That is, an external shoulder 532 of an enlarged portion 538 of the inner drill rod 520 can be pushed into contact with an internal shoulder 530 of the outer drill rod 510. This up-hill position is typically experienced in the lower down-hill drill rod assemblies of a drill string, as previously described in the background of this disclosure.

Figure 26:
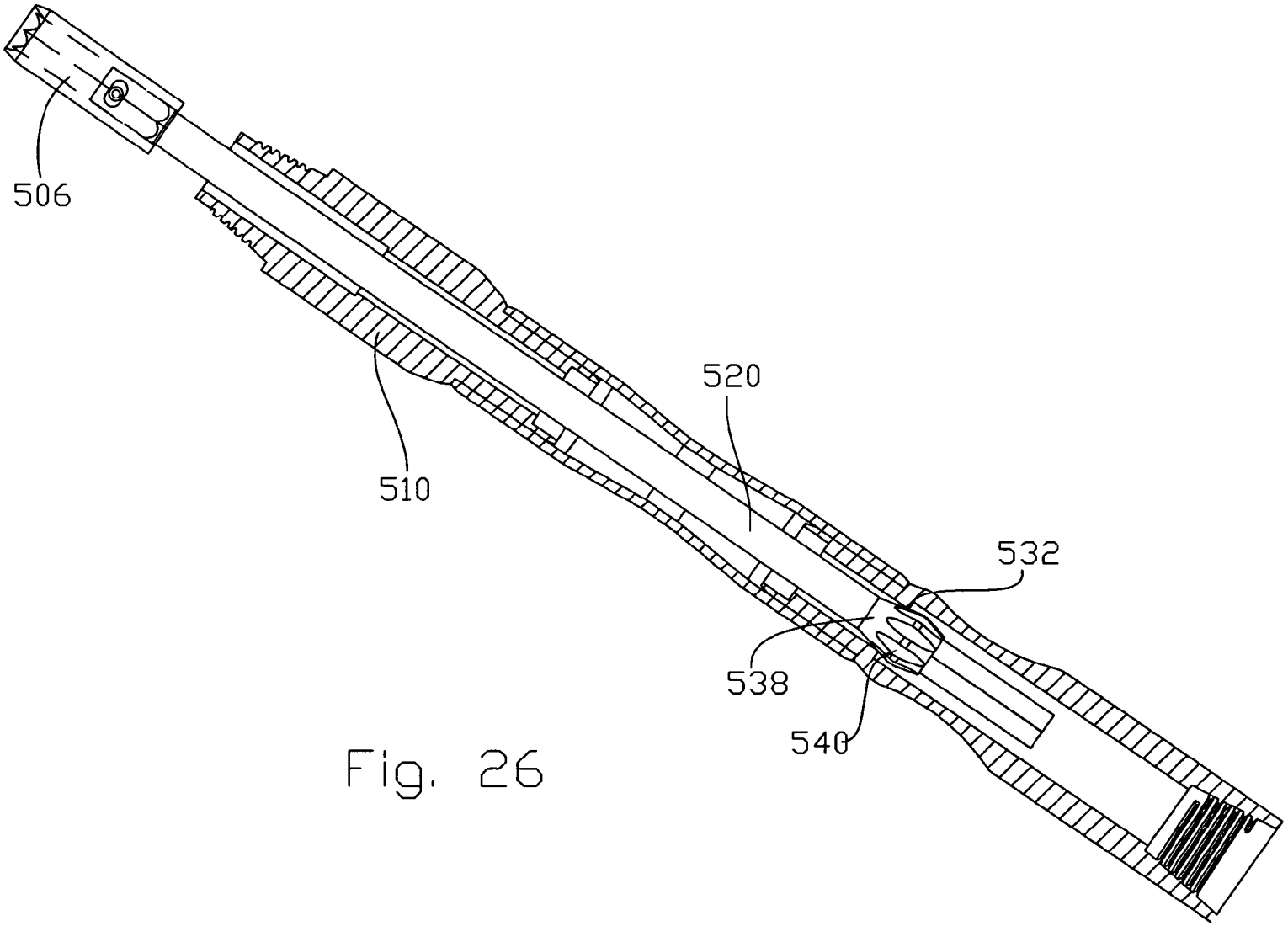
FIG. 26 is a cross-sectional view of one of the drill rod assemblies of FIG. 25.
Figure 27:
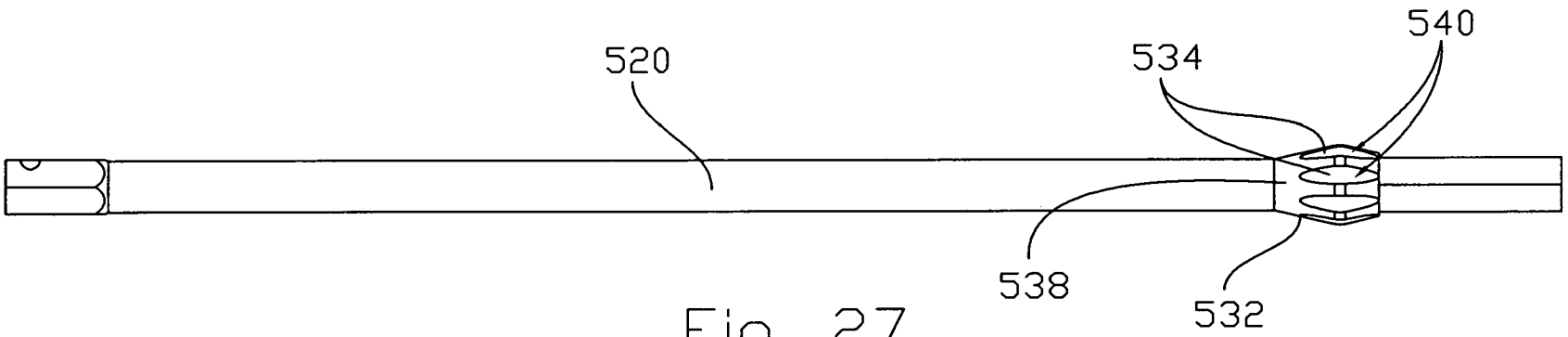
FIG. 27 is side elevation view of a drill rod of the drill rod assembly of FIG. 26.

Referring now to FIGS. 26 and 27, the passages 540 of the drill rod assembly 500 are formed in the external shoulder 532 of the enlarge portion 538 of the inner drill rod 520. In particular, the external shoulder 532 includes slots or notches 534. The notches 534 define the passages 540 that prevent flow blockage between the annular flow path 560*b* (FIG. 25) of an up-hill drill rod assembly and the annular flow path 560*a* of a down-hill drill rod assembly.

Although no specific number of notches 534 in the external shoulder 532 is required, preferably, the specific number of notches 534 balances the need for an adequate cross-sectional flow area with the need for adequate structural area of the shoulder 532. That is, the number of notches 534 preferably maximizes fluid flow, without jeopardizing the structural strength of the external shoulder 532. In an alternative embodiment, passages can also be formed in the internal shoulder (not shown) to prevent flow blockage at this particular region of the drill rod assembly.

As noted above, the drill rods are typically positioned in the drilling machine, with one end higher than the other during operation of the drilling machine; thus, the description has utilized the terms up-hill end and a down-hill end. It will be appreciated, however, that the use of such terms are for the purposes of describing preferred embodiments of the present invention and should not be construed as limiting. Those of skill in the art will appreciate that the drill rods may be positioned with the ends reversed. Further, in operation once the drill rods are employed during horizontal directional drilling, the drill rods may be horizontal and/or at an angle which differs from the original angle on the drilling machine.

Various principles of the embodiments included in the present disclosure may be used in other applications. The above specification provides a complete description of the present invention. Since many embodiments of the invention can be made without departing from the spirit and scope of the invention, certain aspects of the invention reside in the claims hereinafter appended.

What is claimed is:

1. A drill rod assembly, comprising:

a) an outer drill rod having a first externally threaded end and a second internally threaded end, the outer drill rod including:

i) a first inner diameter and a second inner diameter, the second inner diameter being greater than the first inner diameter; and ii) an internal shoulder located at a transition between the first and second inner diameters;

b) an inner drill rod having first and second hexagonal ends, the inner drill rod being positioned within the outer drill rod such that an annular fluid flow path is defined between the inner and outer drill rods, the inner drill rod including an external shoulder sized to engage the internal shoulder of the outer drill rod to limit movement of the inner drill rod relative to the outer drill rod in a first longitudinal direction;

c) a coupling attached to the second end of the inner drill rod, the coupling having an outer diameter at a first end that exceeds the first inner diameter of the outer drill rod to limit movement of the inner drill rod relative to the outer drill rod in a second opposite longitudinal direction; and d) wherein the coupling defines fluid flow passages that are in fluid communication with the annular fluid flow path when the coupling is seated against the outer drill rod.

2. The drill rod assembly of claim 1, wherein the external shoulder of the inner drill rod defines fluid flow passages that are in fluid communication with the annular fluid flow path when the external shoulder of the inner drill rod is seated against the internal shoulder of the outer drill rod.

3. The drill rod assembly of claim 1, wherein the fluid flow passages defined by slots formed in the coupling.

4. The drill rod assembly of claim 3, further including slots formed in the externally threaded end of the outer drill rod, the slots of the coupling being located adjacent to the slots of the threaded end of the outer drill rod, the slots of each of the coupling and the threaded end of the outer drill rod defining the fluid flow passage that are in fluid communication with the annular fluid flow path.

5. The drill rod assembly of claim 3, wherein the slots are generally square in shape.

6. The drill rod assembly of claim 1, wherein the fluid flow passage include radially extending cross-drill holes located at one end of the coupling.

7. The drill rod assembly of claim 6, wherein the second hexagonal end of the inner drill rod is offset such that a round portion of the inner drill rod aligns with the holes of the coupling.

8. The drill rod assembly of claim 1, wherein the fluid flow passages include longitudinal clearance bores that extend from a first end of the coupling to a second end of the coupling.

9. A drill rod assembly, comprising:

a) an outer drill rod having a first externally threaded end and a second internally threaded end, the outer drill rod including:

i) a first inner diameter and a second inner diameter, the second inner diameter being greater than the first inner diameter; and ii) an internal shoulder located at a transition between the first and second inner diameters;

b) an inner drill rod having first and second hexagonal ends, the inner drill rod being positioned within the outer drill rod such that an annular fluid flow path is defined between the inner and outer drill rods, the inner drill rod including an external shoulder sized to engage the internal shoulder of the outer drill rod to limit movement of the inner drill rod relative to the outer drill rod in a first longitudinal direction; and c) a coupling attached to the second end of the inner drill rod, the coupling having an outer diameter that exceeds the first inner diameter of the outer drill rod to limit movement of the inner drill rod relative to the outer drill rod in a second opposite longitudinal direction;

d) wherein the external shoulder of the inner drill rod defines fluid flow passages that are in fluid communication with the annular fluid flow path when the external shoulder of the inner drill rod is seated against the internal shoulder of the outer drill rod.

10. A drill rod assembly, comprising:

a) an outer drill rod having a first externally threaded end and a second internally threaded end;

b) an inner drill rod having first male hexagonal end and a second end, the inner drill rod being positioned within the outer drill rod such that an annular fluid flow path is defined between the inner and outer drill rods;

c) a coupling attached to the second end of the inner drill rod, the coupling having a female hexagonal end;

d) wherein the inner drill rod defines a fluid flow passage, the fluid flow passage providing fluid communication between the annular fluid flow path defined by the inner and outer drill rods and another annular fluid flow path of a second drill rod assembly when the second drill rod assembly is coupled to one of the first and second ends of the outer drill rod.

11. The drill rod assembly of claim 10, wherein the fluid flow passages include longitudinal notches formed in at least one of the first male hexagonal end and the second end of the inner drill rod.

12. The drill rod assembly of claim 11, wherein the longitudinal notches are formed in each of the first and second hexagonal ends of the inner drill rod.

13. The drill rod assembly of claim 10, wherein the fluid flow passage is defined by the coupling attached to the second end of the inner drill rod, the fluid flow passage including a radially extending cross-drill hole located at one end of the female hexagonal end and a second end of the coupling, and wherein the second end of the inner drill rod is offset such that a round portion of the inner drill rod aligns with the hole of the coupling.

14. A method of forming a drill rod, comprising:

a) forming a first outer drill rod, the first outer drill rod having a first externally threaded end and a second internally threaded end, the first outer drill rod further including:

i) a first inner diameter and a second inner diameter, the second inner diameter being greater than the first inner diameter; and iii) an internal shoulder located at a transition between the first and second inner diameters;

b) forming a first inner drill rod, the first inner drill rod having a first and a second hexagonal end, the first inner drill rod being positioned within the first outer drill rod, wherein an annular fluid flow path is defined between the first inner and first outer drill rod;

c) forming an external shoulder on the first inner drill rod, the external shoulder arranged and configured to engage the internal shoulder of the first outer drill rod to limit movement of the first inner drill rod relative to the first outer drill rod in a first longitudinal direction; and d) attaching a coupling to the second end of the first inner drill rod, the coupling having an outer diameter at a first end that exceeds the first inner diameter of the first outer drill rod to limit movement of the first inner drill rod relative to the first outer drill rod in a second opposite longitudinal direction, wherein the coupling defines fluid flow passages that are in fluid communication with the annular fluid flow path when the coupling is seated against the outer drill rod.

15. The method of claim 14, further comprising forming fluid flow passages in the external shoulder of the first inner drill rod, the fluid flow passages in fluid communication with the annular fluid flow path when the external shoulder of the first inner drill rod is seated against the internal shoulder of the first outer drill rod.

16. The method of claim 15, wherein the fluid flow passages are defined by slots formed in the coupling.

17. The method of claim 16, further comprising forming slots in the externally threaded end of the first outer drill rod, the slots of the coupling being located adjacent to the slots of the threaded end of the first outer drill rod, the slots of each of the coupling and the threaded end of the first outer drill rod defining the fluid flow passage that are in fluid communication with the annular fluid flow path.

18. The method of claim 16, wherein the slots are generally square in shape.

19. The method of claim 14, wherein the fluid flow passages defined by the coupling include radially extending cross-drill holes located at one end of the first end and a second end of the coupling, and wherein the second hexagonal end of the inner drill rod is offset such that a round portion of the inner drill rod aligns with the holes of the coupling.

20. A method of forming a drill string, comprising:

a) forming first and a second outer drill rods, the first and second outer drill rods each having a first externally threaded end and a second internally threaded end, the first and second outer drill rods further including:

i) a first inner diameter and a second inner diameter, the second inner diameter being greater than the first inner diameter; and iii) an internal shoulder located at a transition between the first and second inner diameters;

b) forming first and second inner drill rods, the first and second inner drill rods having a first and a second hexagonal end, the first and second inner drill rods being positioned within the first and second outer drill rods, respectively, wherein an annular fluid flow path is defined between the first inner and first outer drill rod and the second inner and second outer drill rod;

c) forming an external shoulder on each of the first and second inner drill rod, the external shoulder arranged and configured to engage the internal shoulder of the first and second outer drill rods, respectively, to limit movement of the first and second inner drill rods relative to the first and second outer drill rods in a first longitudinal direction;

d) attaching a coupling to the second end of the first and second inner drill rods, the coupling having an outer diameter at a first end that exceeds the first inner diameter of the first and second outer drill rods to limit movement of the first and second inner drill rods relative to the first and second outer drill rods in a second opposite longitudinal direction, wherein the coupling defines fluid flow passages that are in fluid communication with the annular fluid flow path when the coupling is seated against the outer drill rod; and e) attaching the first inner drill rod to the second inner drill rod and attaching the first outer drill rod to the second outer drill rod, whereby a drill string is formed.

21. The method of claim 20, wherein the fluid flow passages defined by the coupling include radially extending cross-drill holes located at one end of the first end and a second end of the coupling, and wherein the second hexagonal end of the first and second inner drill rods is offset such that a round portion of the inner drill rods aligns with the holes of the coupling.

* * * * *

UNITED STATES PATENT AND TRADEMARK OFFICE

CERTIFICATE OF CORRECTION

PATENT NO. : 7,694,753 B2
APPLICATION NO. : 11/805695
DATED : April 13, 2010
INVENTOR(S) : R. Carlson et al.

It is certified that error appears in the above-identified patent and that said Letters Patent is hereby corrected as shown below:

Col. 12, line 34: "defined" should read --are defined--

Signed and Sealed this

Twenty-first Day of September, 2010

David J. Kappos

David J. Kappos
*Director of the United States Patent and Trademark Office*